US008070014B2

(12) United States Patent
Wisniewski

(10) Patent No.: US 8,070,014 B2
(45) Date of Patent: Dec. 6, 2011

(54) LINER PIERCING TWIST CLOSURE

(75) Inventor: John Wisniewski, Wauwatosa, WI (US)

(73) Assignee: Seaquist Closures L.L.C., Mukwonago, WI (US)

( * ) Notice: Subject to any disclaimer, the term of this patent is extended or adjusted under 35 U.S.C. 154(b) by 1124 days.

(21) Appl. No.: 11/895,598

(22) Filed: Aug. 24, 2007

(65) Prior Publication Data

US 2009/0050648 A1 Feb. 26, 2009

(51) Int. Cl.
*B67D 1/00* (2006.01)

(52) U.S. Cl. ..... 222/83; 222/81; 222/494

(58) Field of Classification Search ..... 222/80, 222/81, 83, 490, 494, 519, 541.2, 548
See application file for complete search history.

(56) References Cited

U.S. PATENT DOCUMENTS

| | | | |
|---|---|---|---|
| 2,336,490 | A | 12/1943 | Lo Vico |
| 2,688,428 | A | 9/1954 | Manhartsberger |
| 3,156,369 | A | 11/1964 | Bowes et al. |
| 3,187,918 | A | 6/1965 | Moore |
| 3,402,855 | A | 9/1968 | Schroeder et al. |
| 3,406,872 | A | 10/1968 | Fiquet et al. |
| 3,580,423 | A | 5/1971 | Gilman |
| 3,613,955 | A | 10/1971 | Wetherell, Jr. |
| 3,802,604 | A | 4/1974 | Morane et al. |
| 3,912,115 | A | 10/1975 | Smith |
| 3,924,777 | A | 12/1975 | Peyser |
| 3,949,898 | A | 4/1976 | Patel et al. |
| 3,968,872 | A | 7/1976 | Cavazza |
| 4,234,103 | A | 11/1980 | Strober, Jr. et al. |
| 4,307,821 | A | 12/1981 | McIntosh |
| 4,340,147 | A | 7/1982 | McIntosh |
| 4,469,249 | A | 9/1984 | Malpas et al. |

(Continued)

FOREIGN PATENT DOCUMENTS

EP 0 296 100 B1 12/1988

(Continued)

OTHER PUBLICATIONS

European Search Report in English dated May 20, 2009 for European application No. 08019276.8-2308.

(Continued)

*Primary Examiner* — Kevin P Shaver
*Assistant Examiner* — Daniel R Shearer
(74) *Attorney, Agent, or Firm* — Wood, Phillips, Katz, Clark & Mortimer

(57) ABSTRACT

A dispensing closure system is provided for a container that has an opening wherein a membrane is interposed between the container opening and the dispensing closure system. The system includes a base for extending from the container at the opening. The base has a receiving passage and an annular sealing flange extending radially inwardly around the passage. A movable spout is mounted in the base receiving passage and has a grippable discharge end that projects axially outwardly from the base receiving passage. The spout has a dispensing passage extending through the spout and has a peripheral sealing surface that is sealingly engaged with the base annular sealing flange. The spout also has a piercing element at an axially inward end of the spout. A cam track is located in either the base or the spout. A cam follower is located on the other one of the base and spout, and the cam follower is engaged in the cam track. The grippable discharge end of the spout can be grasped to rotate the spout for moving the spout axially to pierce the membrane.

17 Claims, 18 Drawing Sheets

U.S. PATENT DOCUMENTS

| | | | | | |
|---|---|---|---|---|---|
| 4,483,464 | A | | 11/1984 | Nomura | |
| 4,583,665 | A | | 4/1986 | Barriac | |
| 4,610,374 | A | | 9/1986 | Buehler | |
| 4,640,424 | A | | 2/1987 | White | |
| 4,706,827 | A | | 11/1987 | Cabernoch et al. | |
| 4,709,822 | A | | 12/1987 | Vataru | |
| 4,722,449 | A | | 2/1988 | Dubach | |
| 4,757,916 | A | | 7/1988 | Goncalves | |
| 4,770,305 | A | | 9/1988 | Su | |
| 4,785,931 | A | | 11/1988 | Weir et al. | |
| 4,795,043 | A | | 1/1989 | Odet et al. | |
| 4,867,326 | A | | 9/1989 | O'Meara | |
| 4,869,399 | A | | 9/1989 | Dubach | |
| 4,884,705 | A | | 12/1989 | Debetencourt | |
| 4,976,379 | A | | 12/1990 | Sloan | |
| 4,979,941 | A | | 12/1990 | Ogle, II | |
| 4,982,875 | A | | 1/1991 | Pozzi et al. | |
| 4,993,569 | A | | 2/1991 | Osip et al. | |
| 5,020,690 | A | * | 6/1991 | Kishikawa et al. | 222/83 |
| 5,042,690 | A | | 8/1991 | O'Meara | |
| 5,058,772 | A | * | 10/1991 | Moore et al. | 222/109 |
| 5,082,136 | A | | 1/1992 | Schumann | |
| 5,090,582 | A | | 2/1992 | Art et al. | |
| 5,094,361 | A | | 3/1992 | Dubach | |
| 5,228,592 | A | | 7/1993 | Pellerano | |
| 5,255,812 | A | | 10/1993 | Hsu | |
| 5,280,764 | A | | 1/1994 | Levinrad | |
| 5,292,025 | A | | 3/1994 | Dubreul | |
| 5,353,928 | A | | 10/1994 | Schumacher | |
| 5,388,690 | A | | 2/1995 | Mutterle et al. | |
| 5,462,200 | A | | 10/1995 | Weiler | |
| 5,469,980 | A | | 11/1995 | O'Meara et al. | |
| 5,474,209 | A | | 12/1995 | Vallet Mas et al. | |
| 5,482,176 | A | | 1/1996 | Maietta et al. | |
| 5,505,326 | A | | 4/1996 | Junko | |
| 5,566,859 | A | | 10/1996 | Willis et al. | |
| 5,590,798 | A | | 1/1997 | O'Connell | |
| 5,642,838 | A | | 7/1997 | Stoody | |
| 5,711,453 | A | | 1/1998 | Weiler | |
| 5,782,345 | A | | 7/1998 | Guasch et al. | |
| 5,853,109 | A | | 12/1998 | Elliott | |
| 5,927,549 | A | | 7/1999 | Wood | |
| 5,944,234 | A | * | 8/1999 | Lampe et al. | 222/490 |
| 5,992,668 | A | | 11/1999 | Elliott | |
| 6,039,198 | A | | 3/2000 | Wolfe et al. | |
| 6,045,004 | A | | 4/2000 | Elliott | |
| 6,056,142 | A | | 5/2000 | Elliott | |
| 6,305,563 | B1 | | 10/2001 | Elliott | |
| 6,315,165 | B1 | | 11/2001 | Regan | |
| 6,422,412 | B1 | | 7/2002 | Sagawa | |
| 6,477,743 | B1 | * | 11/2002 | Gross et al. | 222/525 |
| 6,571,994 | B1 | | 6/2003 | Adams et al. | |
| 6,659,308 | B1 | * | 12/2003 | Kelder et al. | 222/83 |
| 7,427,005 | B1 | | 9/2008 | Lohrman | |
| 2006/0057257 | A1 | | 3/2006 | Ma | |
| 2006/0163281 | A1 | | 7/2006 | Weist | |
| 2008/0245314 | A1 | | 10/2008 | Brodowski | |

FOREIGN PATENT DOCUMENTS

| | | | |
|---|---|---|---|
| EP | 0 473 678 | B1 | 3/1992 |
| EP | 0 747 294 | A1 | 12/1996 |
| EP | 1 112 943 | A1 | 4/2001 |
| JP | 2006-82847 | | 3/2006 |
| WO | WO 97/00816 | | 1/1997 |
| WO | WO 99/47450 | | 9/1999 |
| WO | WO 00/00405 | | 1/2000 |
| WO | WO 01/05674 | A1 | 1/2001 |
| WO | WO 2005/009847 | A1 | 3/2005 |
| WO | WO 2008/004442 | A1 | 4/2008 |

OTHER PUBLICATIONS

English language patent abstract of Japan supplied by the European Patent Office for JP 2006082847 A.

U.S. Appl. No. 11/906,367, filed Oct. 2, 2007.

* cited by examiner

LINER PIERCING TWIST CLOSURE

TECHNICAL FIELD

This invention relates to container closures for dispensing a fluent substance. The invention is more particularly related to a dispensing closure for use with a container wherein a membrane is interposed between the container and the dispensing closure.

BACKGROUND OF THE INVENTION AND TECHNICAL PROBLEMS POSED BY THE PRIOR ART

Fluent materials, including liquids, creams, powders, etc., may be conventionally packaged in a container having a dispensing closure which includes a body portion which is located on the top of the container and which defines one or more dispensing apertures or openings. A cap or lid may be provided for being releasably secured to the body portion for occluding the dispensing opening when the container is not in use. This prevents spillage if the container is dropped or tipped over. The lid may also help keep the contents fresh and may reduce the ingress of contaminants.

A variety of dispensing closure designs have been developed for various products which are in liquid or powder form (e.g., shampoo, lotion, cosmetic powder, etc.). One type of closure includes a flexible, self-closing, slit-type dispensing valve mounted over the container opening. The valve has a slit or slits which define a normally closed orifice that opens to permit flow therethrough in response to increased pressure within the container when the container is squeezed. One widely used form of the valve automatically closes to shut off flow therethrough upon removal of the increased pressure. Designs of closures using such valves are illustrated in the U.S. Pat. No. 5,271,531, U.S. Pat. No. 5,927,566, and U.S. Pat. No. 5,934,512. Typically, the closure includes a base mounted on the container neck to define a seat for receiving the valve and includes a retaining ring or housing structure for holding the valve on the seat in the base. See, for example, U.S. Pat. No. 6,269,986 and U.S. Pat. No. 6,616,016. U.S. Pat. No. 5,839,626 discloses a closure having a valve from which a powder is discharged through a perforated dispensing baffle to produce a desirable dispersed distribution pattern of fine powder (e.g., cosmetic powder). A closure can also be provided with a lid for covering a valve during shipping or when the container is packed for travel (or when the container is otherwise not in use). See, for example, FIGS. 31-34 of U.S. Pat. No. 5,271,531. The lid can keep the valve clean and/or protect the valve from damage.

In some packages, it is also desirable to interpose a membrane (e.g., a seal or liner) across the container opening and to provide a closure that (1) is installed on the container over the membrane, and (2) has an element that can be rotated to open the membrane by piercing or cutting the membrane. See, for example, U.S. Pat. Nos. 4,853,665, 4,884,705, and 5,482,176.

The inventor of the present invention has discovered that it would be advantageous to provide an improved closure for dispensing a fluent product, including liquid. In particular, the inventor has discovered that his innovative design provides advantages not heretofore contemplated in the packaging industry or suggested by the prior art.

SUMMARY OF THE INVENTION

The inventor of the present invention has invented an innovative dispensing closure which, inter alia, can be provided with a lid (or not) and which requires only two relatively movable portions, (1) a base, and (2) a spout, and wherein (1) the spout can be initially installed through the bottom of the base, (2) the closure accommodates rotation of the spout member relative to the base (in the conventional counterclockwise opening rotation direction pursuant to a preferred embodiment) to effect axial movement of a spout for driving a piercing element to cut at least one flow aperture in a membrane interposed between the container and closure, (3) engaged drive/driven surfaces defined by the spout and base are sealed internally within the closure and are not exposed to the ambient environment before, during, or after operation, and (4) further manipulation is not required after cutting the membrane to permit product dispensing (assuming the optional lid, if any, has been first opened).

In one preferred embodiment, the dispensing closure includes both a lid and a valve. The use of a valve can prevent spillage if the container is inadvertently dropped, and can minimize contaminant ingress even if the container is not closed with a lid. The dispensing closure is especially suitable for use in dispensing a liquid.

The present invention permits the user to conveniently open a membrane (such as a conventional liner) by piercing it without having to manipulate the package so as to first expose the membrane and without requiring removal of the membrane per se. The membrane, after piercing, can then remain on the container under the closure so that it does not present a litter problem or a choking problem for children.

The present invention dispensing closure inhibits tampering with the package.

Additionally, the inventive dispensing closure components can be designed for easily accommodating the assembly of the components during manufacture of the closure.

Also, the inventive dispensing closure can optionally be provided with a design that accommodates efficient, high quality, large volume manufacturing techniques with a reduced product reject rate.

According to the present invention, an improved dispensing closure is provided for a container that has an opening to the container interior where a fluent substance (i.e., product) may be stored. A membrane is initially interposed between the container and the dispensing closure. For example, the membrane can be sealed across the top of the container opening and/or across the interior of the dispensing closure to occlude the container opening.

The dispensing closure includes a base for extending from the container at the container opening. The base defines (1) a receiving passage through the base, and (2) an annular sealing flange that (a) is located axially outwardly of at least part of the length of the receiving passage, and (b) extends radially inwardly from a peripheral portion of the receiving passage to define an opening into the receiving passage.

The dispensing closure also includes a movable spout that (1) is at least partly disposed in the base receiving passage, (2) has a dispensing passage extending through the spout, (3) has a grippable discharge end that (a) is located at an axially outward end of the spout, and (b) projects axially outwardly from the base, (4) has a peripheral sealing surface that is sealingly engaged by the base annular sealing flange, and (5) has a piercing element at an axially inward end of the spout.

The dispensing closure further includes a cam track located in either the base or spout axially inwardly of the annular sealing flange. The closure also includes a cam follower that is (1) located on the other one of the base and spout, and (2)

engaged in the cam track whereby the spout grippable discharge end can be grasped to rotate the spout axially from an axially outward, non-piercing location to an axially inward, piercing location.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, many of the figures illustrating the invention show a dispensing closure system in one preferred form of a separate, non-removable, dispensing closure in the typical orientations that the closure have when installed on the top of a container when the container is stored upright on its base, and terms such as upper, lower, horizontal, etc., are used with reference to this position. It will be understood, however, that the closure system of this invention may be manufactured, stored, transported, used, and sold in an orientation other than the orientations described.

The dispensing closure system of this invention is suitable for use with a variety of conventional or special fluent substance dispensing systems, including packages, articles, and other dispensing equipment or apparatus, the details of which, although not fully illustrated or described, would be apparent to those having skill in the art and an understanding of such fluent substance dispensing systems. Such a fluent substance dispensing system, or portion thereof, with which the inventive dispensing closure system cooperates is hereinafter simply referred to as a "container." The particular container, per se, that is illustrated and described herein forms no part of, and therefore is not intended to limit, the broad aspects of the present invention. It will also be understood by those of ordinary skill that novel and non-obvious inventive aspects are embodied in the described exemplary dispensing closure system alone.

Figure 1:
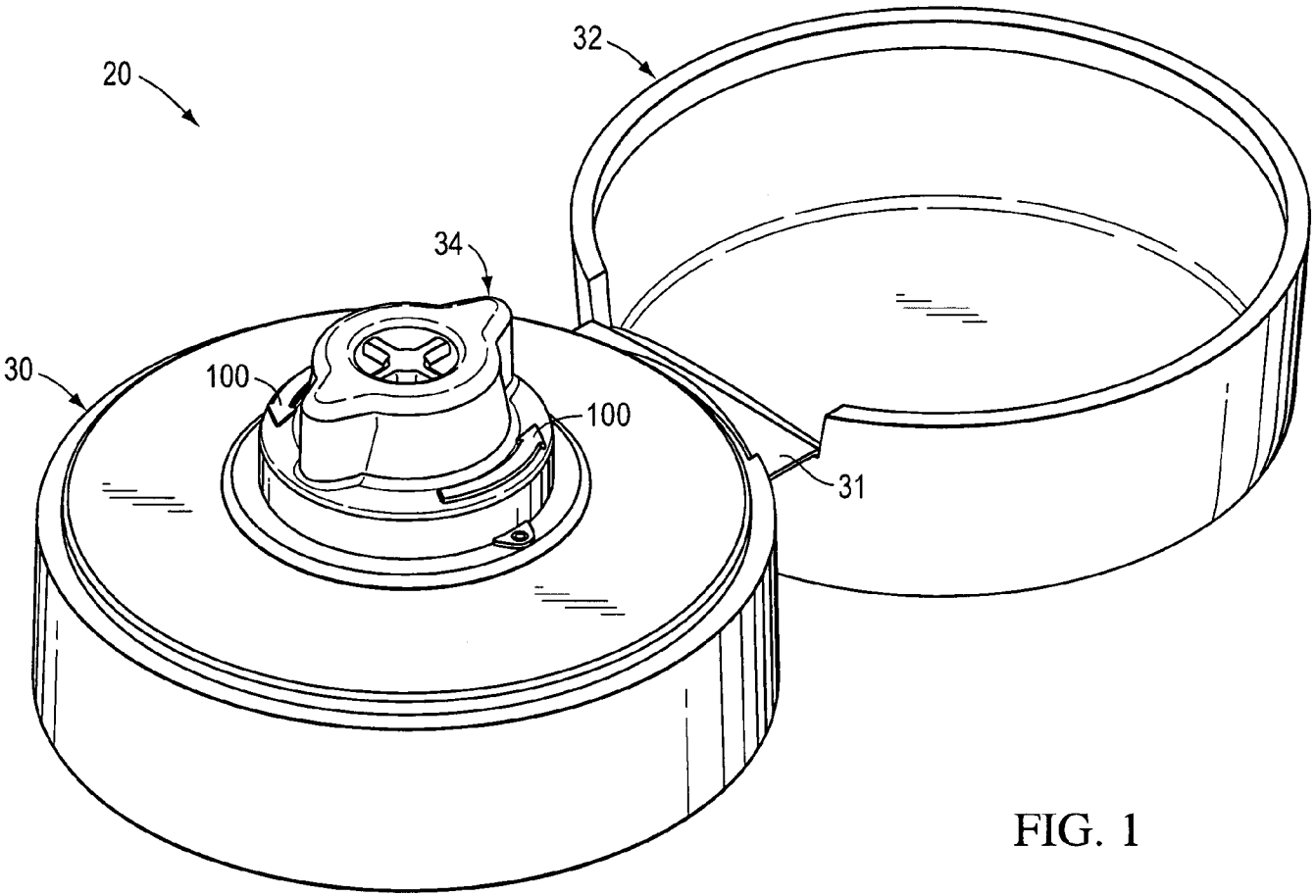
FIG. 1 is an isometric view of a dispensing closure of the present invention in the form of a separate dispensing closure according to a preferred embodiment of the invention, and the closure is shown in an as-molded, open condition prior to installation on a container and is shown with the spout in the axially outward (elevated) non-piercing location.

A presently preferred embodiment of a dispensing closure system of the present invention is illustrated in FIGS. 1-20 and is designated generally in many of those figures by reference number 20 (e.g., in FIG. 1). In the preferred embodiment illustrated, the closure system 20 is provided in the form of a separate dispensing closure 20 which is adapted to be mounted or installed on a container 22 (see, for example, FIGS. 4, 7, and 9), and the container 22 would typically contain a fluent substance.

Figure 9:
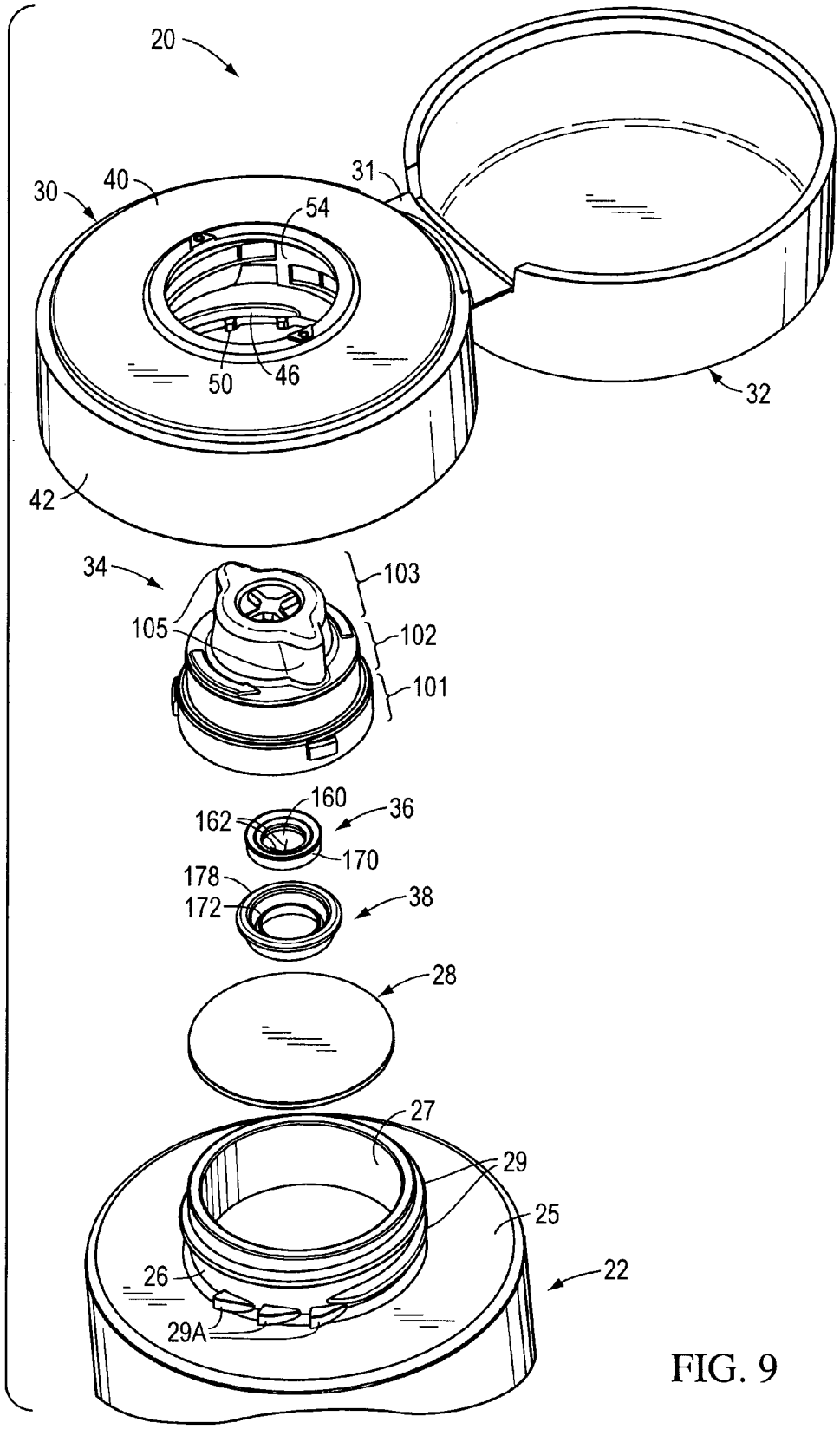
FIG. 9 is an exploded, isometric view of the closure and part of the container shown in FIG. 7, but in FIG. 9 the closure spout has been rotated about 90° compared to FIG. 7.

As can be seen in FIG. 9, the container 22 includes an annular shoulder 25 at the upper end of the hollow body portion of the container 22. A neck 26 extends upwardly from the inner radius of the shoulder 25. The neck 26 defines an opening 27 (FIG. 9) to the container interior.

Figure 7:
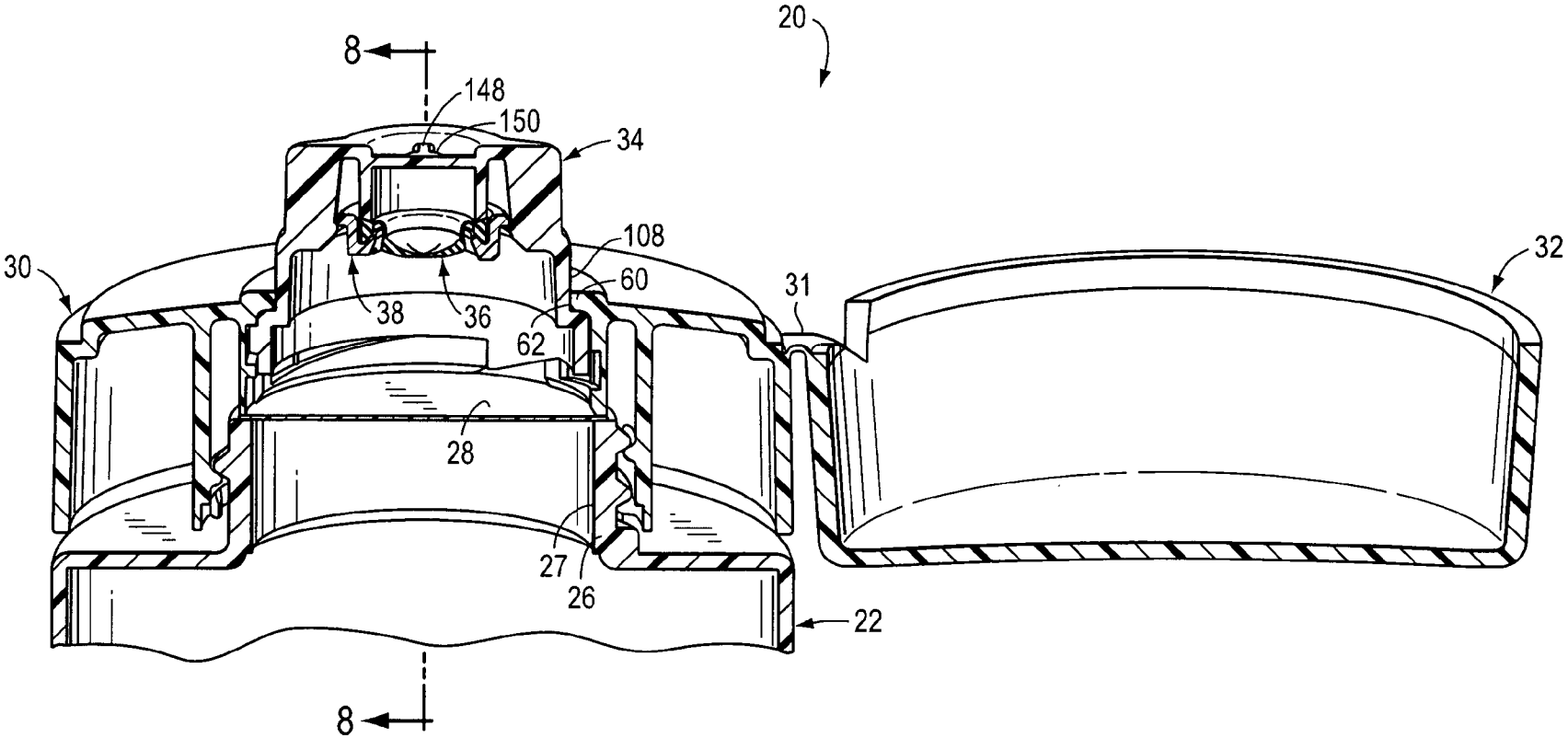
FIG. 7 is a view of the closure similar to FIG. 4, but FIG. 7 shows the closure lid.
Figure 20:
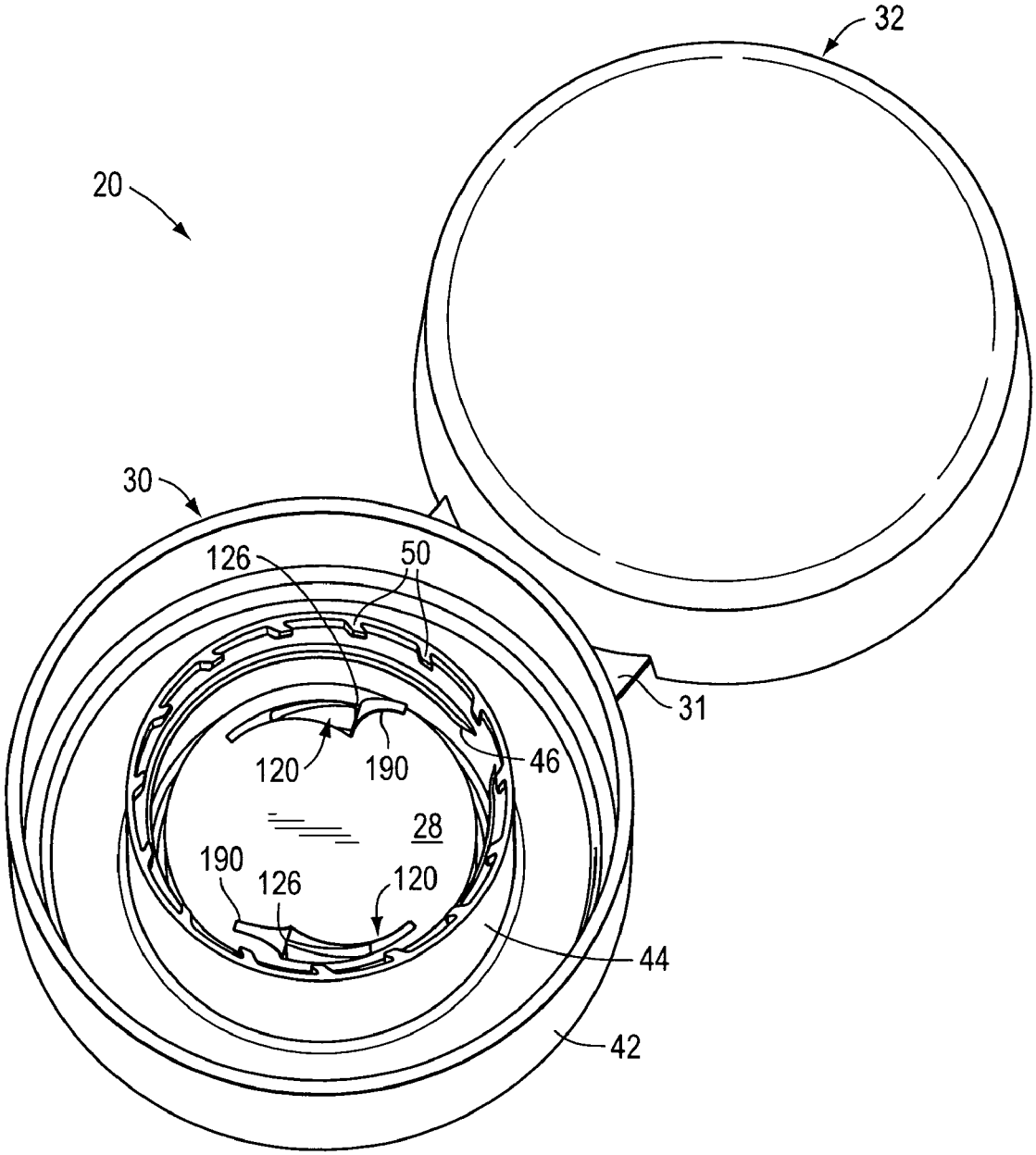
FIG. 20 is an isometric view of the open closure body or base and lid, looking into the bottom, underside of the closure body or base (and with the container omitted for ease of illustration) with the membrane liner also shown being pierced by the piercing elements of the spout.

With reference to FIGS. 7 and 9, a tamper-evident liner 28, defined by a membrane in the form of a pierceable disk, is initially disposed across the top of the container neck 26 over the opening 27 within the closure 20. That is, the membrane, disk, or liner 28 is interposed between the container 22 and the closure 20. FIGS. 4-10 show the liner 28 before it is pierced when the user manipulates the closure as described in detail hereinafter, and FIGS. 9 and 20 show the liner 28 after piercing. The liner 28 may be of any special or conventional type (e.g., aluminum foil (with or without a top and/or bottom laminated layer of thermoplastic material), or a completely non-metallic membrane that includes at least one layer of a thermoplastic material).

In one preferred embodiment form of a package employing the closure of the present invention, the liner 28 is typically heat sealed across, and to, the top of the container neck 26. The liner 28 could alternatively be sealed across, and to, a downwardly facing, interior surface or surfaces of the closure 20, instead of, or in addition to, being sealed across, and to, the top of the container neck 26.

The container neck 26, in the preferred embodiment illustrated in FIG. 9, has an external, male thread 29 for engaging the dispensing closure system 20. The body of the container 22 may have any suitable configuration, and the upwardly projecting neck 26 may have a different cross-sectional size and/or shape than the container body. (Alternatively, the container 22 need not have a neck 26, per se. Instead, the container 22 may consist of only a body with an opening).

In one presently preferred embodiment, the closure 20 is adapted to be threadingly, but non-removably, attached to the top of the container 22. To this end, the upper portion of the container, such as the neck 26, includes one or more anti-rotation teeth 29A (FIG. 9) for engaging a portion of the closure 20 as described in more detail hereinafter. In the preferred embodiment illustrated in FIGS. 6 and 10, there are two sets of anti rotation teeth 29A wherein each set comprises three teeth 29A (see FIG. 6), and the two sets of teeth 29A are located diametrically opposite each other.

Although the container 22, per se, does not form a part of the broadest aspects of the present invention, per se, it will be appreciated that at least a portion of the dispensing closure system 20 of the present invention optionally may be provided as a unitary portion, or extension, of the top of the container 22. However, in the preferred embodiment illustrated, the dispensing closure system 20 is a completely separate article or unit (e.g., a dispensing closure 20) which can comprise either one piece or multiple pieces, and which is adapted to be removably, or non-removably, installed either on a previously manufactured container 22 that has an opening 27 to the container interior or on some other fluent substance handling system. Hereinafter, the dispensing closure system or dispensing closure 20 will be more simply referred to as the closure 20.

The illustrated, preferred embodiment of the closure 20 is adapted to be used with a container 22 having an opening 27 to provide access to the container interior and to a product (i.e., a material in the form of a fluent substance) contained therein (after the liner 28 is pierced). The closure 20 can be used to dispense various substances, including, but not limited to, liquids, suspensions, mixtures, etc. (such as, for example, a personal care product, an industrial or household cleaning product, or other compositions of matter (e.g., compositions for use in activities involving manufacturing, commercial or household maintenance, construction, agriculture, medical treatment, military operations, etc.)).

The container 22 with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system (not illustrated), or to reduce the exterior ambient pressure around the exterior of the closure so as to suck the material out through the open closure.

In another alternate embodiment (not illustrated) wherein the closure does not contain a pressure-actuatable valve, the container may be substantially rigid, especially in applications where the product is a low viscosity liquid that can be readily dispensed by inverting the container and then pouring the liquid through the opened closure.

It is presently contemplated that many applications employing the closure 20 will conveniently be realized by molding at least some of the components of the closure 20 from suitable thermoplastic material or materials. In the preferred embodiment illustrated, some of the components of the closure could be molded from a suitable thermoplastic material, such as, but not limited to, polypropylene. The closure components may be separately molded—and may be molded from different materials. The materials may have the same or different colors and textures.

As can be seen in FIG. 9, the presently most preferred form of the closure 20 includes four basic components, (1) a unitary molded body or base 30 and a cap or lid 32 connected together with an attached hinge 31, (2) a spout 34, (3) a dispensing valve 36 which is adapted to be mounted in the spout 34, and (4) a retaining ring 38 that retains the valve 36 in the upper part of the spout 34.

Figure 3:
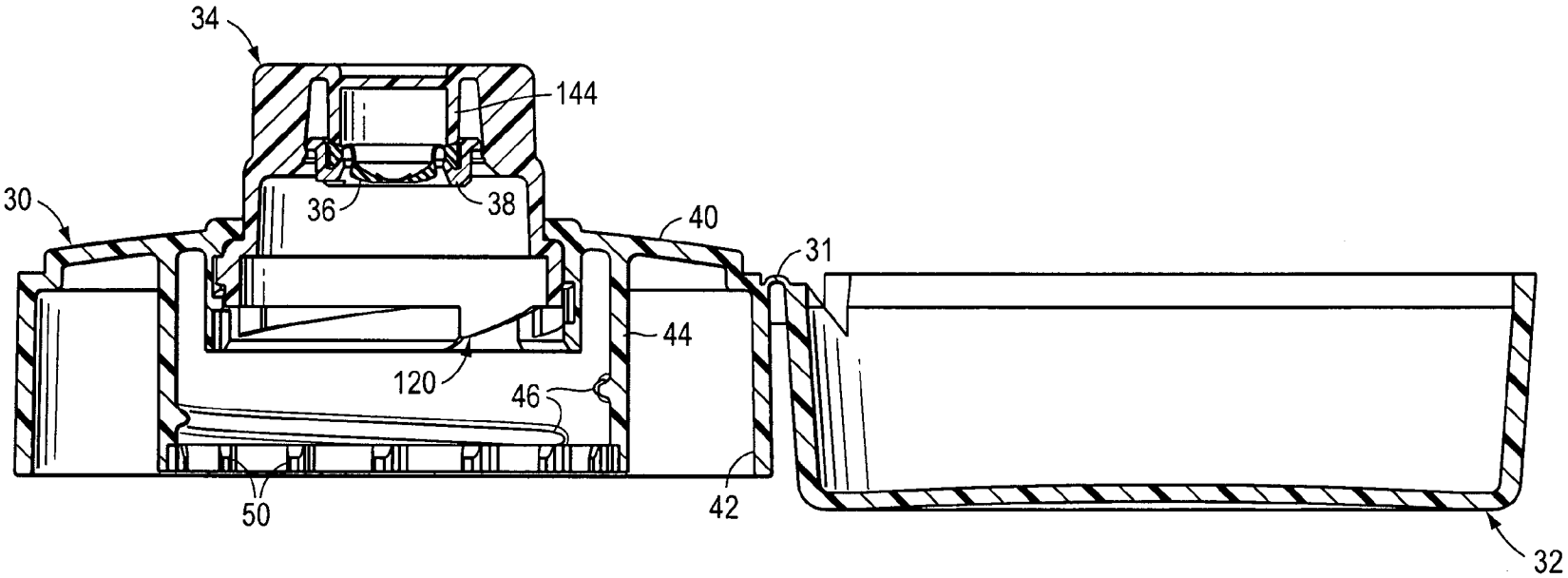
FIG. 3 is a cross-sectional view taken along the plane 3-3 in FIG. 1.
Figure 4:
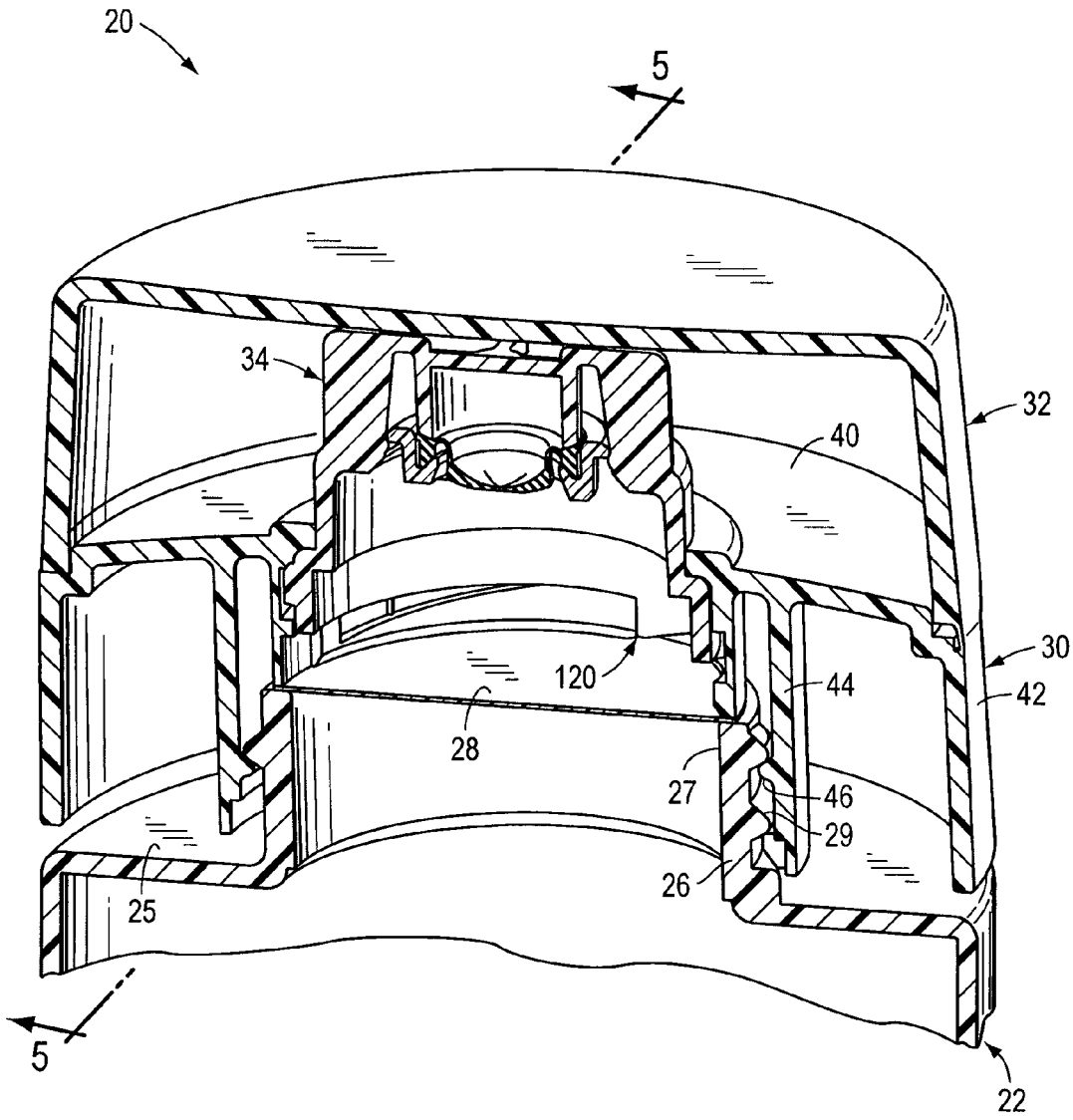
FIG. 4 is a fragmentary, isometric view, also in cross section similar to FIG. 3, but in FIG. 4 the closure lid is closed and the closure is shown installed on a container.
Figure 5:
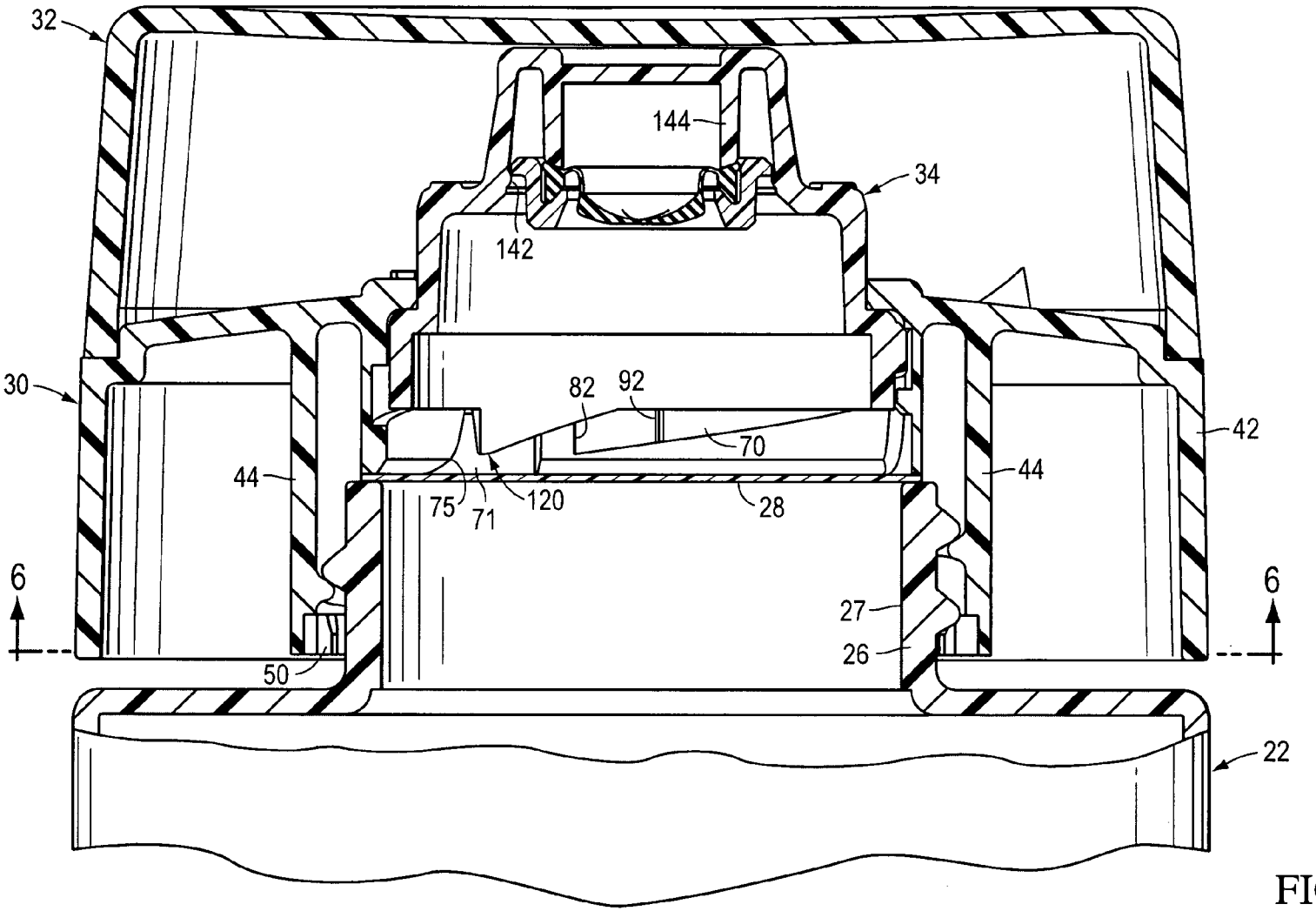
FIG. 5 is a fragmentary, cross-sectional view taken along the plane 5-5 in FIG. 4.
Figure 6:
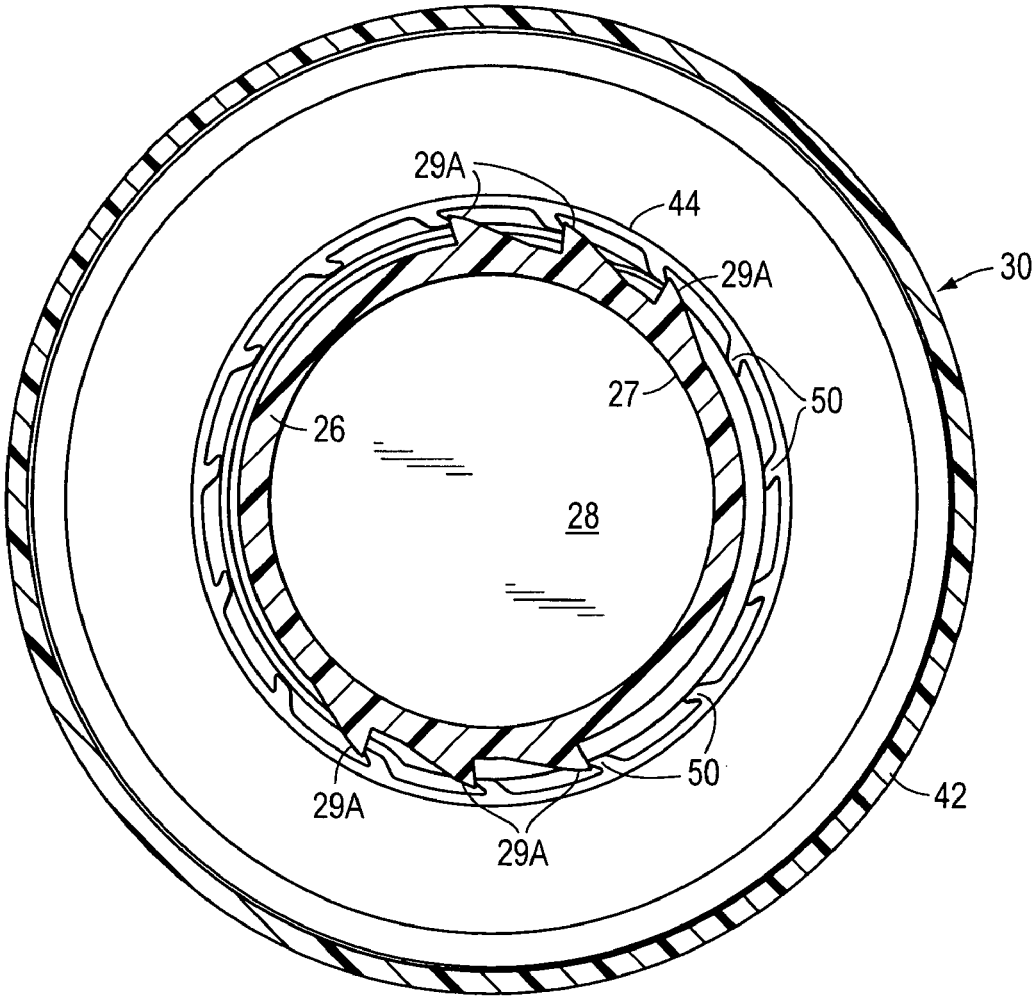
FIG. 6 is a cross-sectional view taken along the plane 6-6 in FIG. 5.

In the preferred form of the invention, the lid 32 is provided to be closed over, and cover, the upper part of the closure base or body 30. The lid 32 can be moved to expose the upper part of the base or body 30 for dispensing. The lid 32 is movable between (1) a closed position over the base or body 30 (as shown in FIG. 4), and (2) an open position (as show in FIGS. 1-3 and 7). In an alternative design (not illustrated), the lid 32 may be a separate component which is completely removable from the closure base 30, or the lid 32 may be tethered to the base 30 with a strap. In another alternative design (not illustrated), the lid could be omitted altogether. In the preferred embodiment illustrated, the lid 32 is hinged to the base 30 so as to accommodate pivoting movement of the lid 32 between the closed position and the open position.

Figure 15:
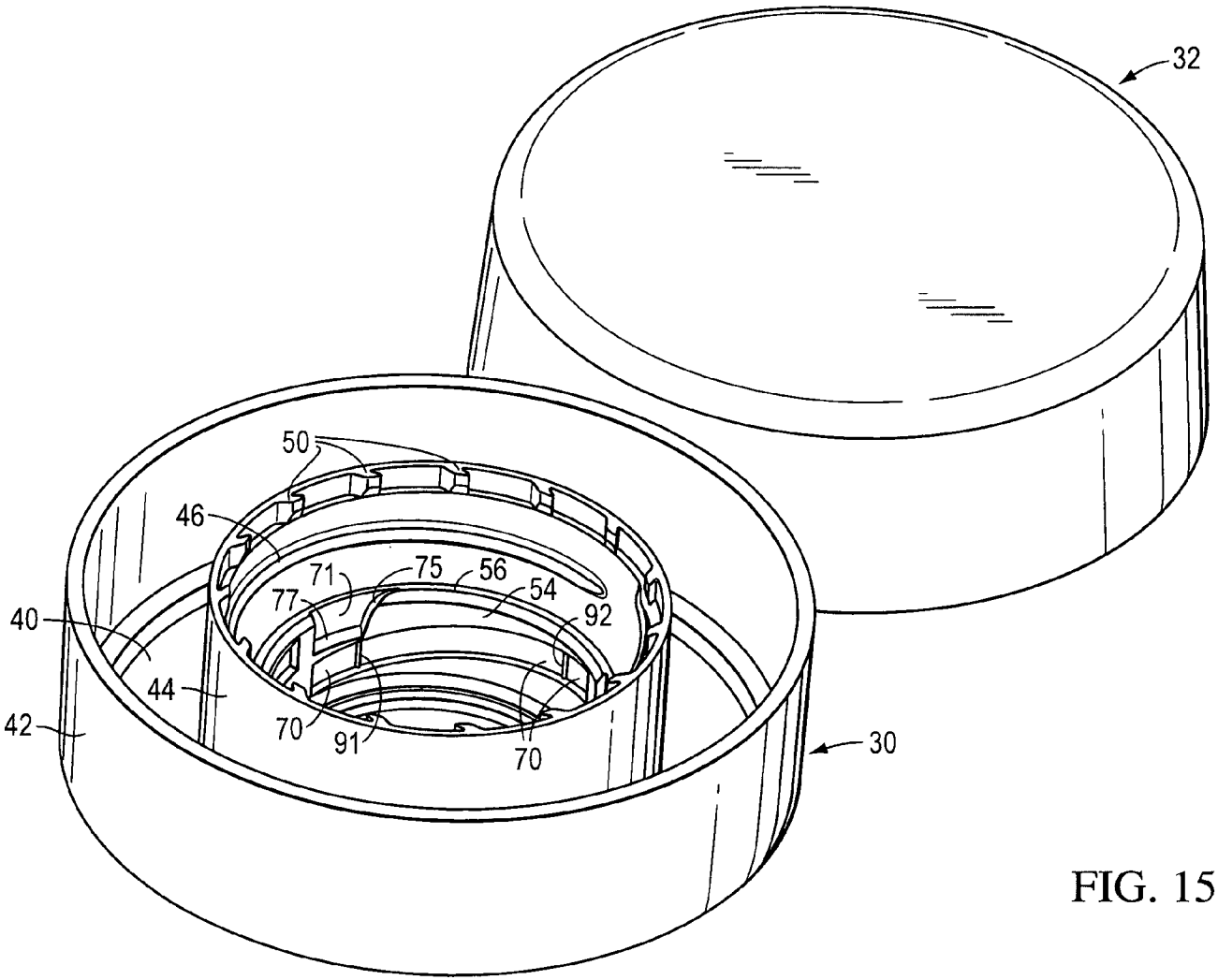
FIG. 15 is an isometric view of the open closure lid and body or base (with the spout removed and not shown), and in FIG. 15 the view is looking into the bottom, underside of the closure body or base.
Figure 16:
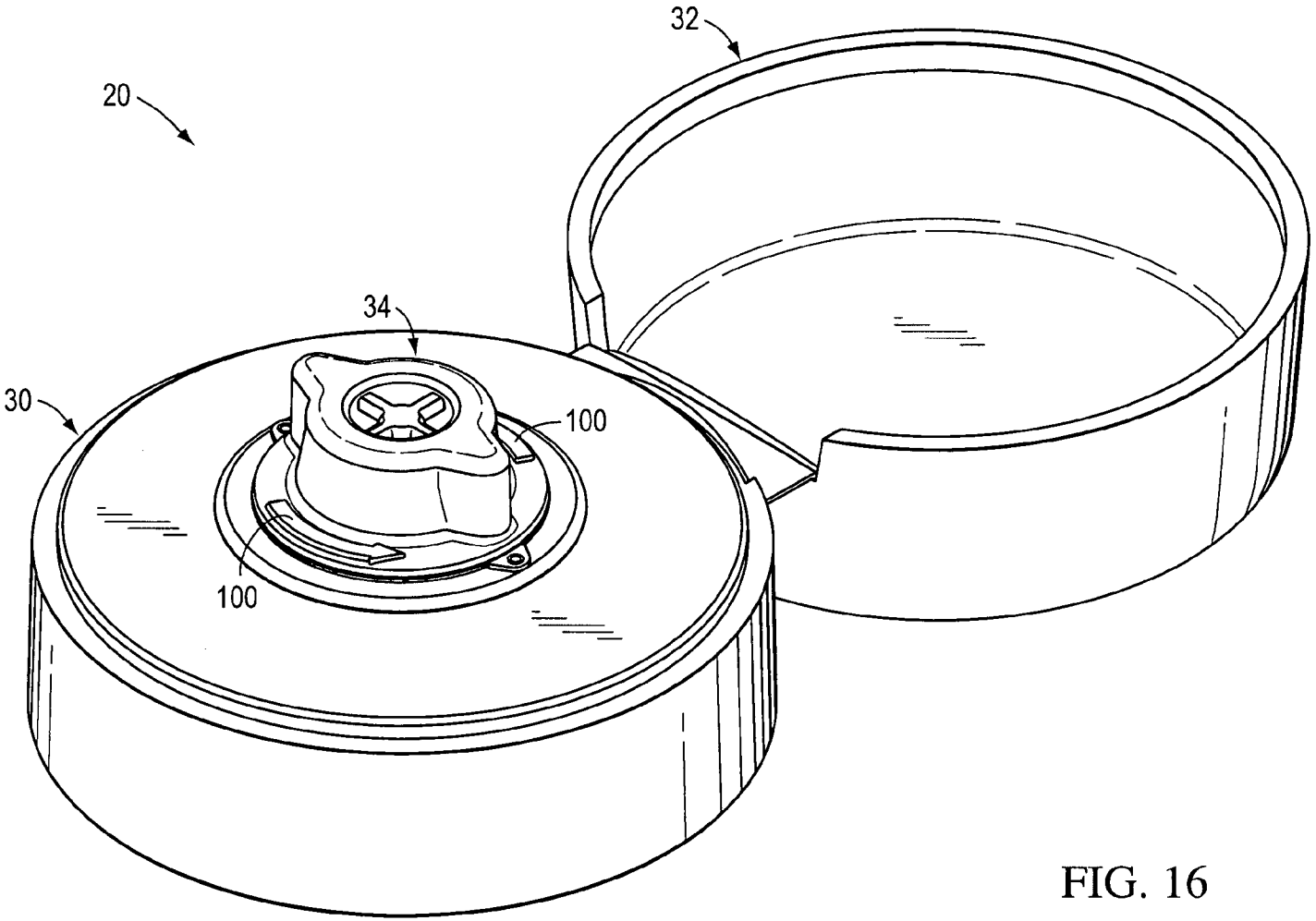
FIG. 16 is an isometric view of the open closure shown in FIG. 1, but in FIG. 16 the spout has been rotated 90° to the axially inward (lowered) piercing location.

As can be seen in FIGS. 9 and 15, the body or base 30 includes a deck 40. A skirt 42 extends downwardly from the periphery of the deck 40. As can be seen in FIGS. 3 and 15, an internal collar 44 extends downwardly from the deck 40 for engaging the container neck 26 when the closure base 30 is mounted on the container 22 (as shown in FIG. 4). As can be seen in FIGS. 3, 9, and 15, the interior of the internal collar 44 defines an internal, female thread 46 for threadingly engaging the container neck external, male thread 29 (FIG. 4) when the dispensing closure base 30 is installed on the container neck 26.

Alternatively, the closure collar 44 could be provided with some other container connecting means, such as a snap-fit bead or groove (not illustrated) for engaging a container neck groove or bead (not illustrated), respectively. Also, the closure base internal collar 44 could instead be permanently attached to the container 22 by means of induction melting, ultrasonic melting, gluing, or the like, depending on materials used for the closure base internal collar 44 and container 22. In such alternate embodiments, the liner 28 would have to be initially sealed across the top of the container neck 26 before permanently attaching the closure 20 to the neck 26, and a conventional liner attaching process may be employed (as discussed hereinafter).

In the base collar 44, below the thread 46, the base collar 44 includes at least one pawl tooth 50 (FIGS. 5, 6, 9, and 15) which is adapted to (1) deflect past the container anti-rotation ratchet teeth 29A when the base 30 is screwed on to the container neck 26, and (2) abut at least one of the container anti-rotation ratchet teeth 29A when torque is applied to the base 30 in the unscrewing direction of rotation thereby preventing unscrewing of the base 30 from the container 22. In the preferred embodiment, there are a plurality of such pawl teeth 50 spaced apart uniformly around the internal circumference of the closure base collar 44.

The closure base collar 44 may have any suitable configuration for accommodating an upwardly projecting neck 26 of the container 22 or for accommodating any other portion of a container received within the particular configuration of the closure base internal collar 44—even if a container does not have a neck, per se. The main part of the container 22 may have a different cross-sectional shape than the container neck 26 and closure base internal collar 44. The closure base internal collar 44 may be adapted for mounting to other types of fluent substance handling container systems (e.g., including dispensing apparatus, machines, or equipment).

In the illustrated embodiment of the invention, the container neck-receiving passage in the closure base internal collar 44 has a generally cylindrical configuration, but includes the inwardly projecting thread 46. However, the closure base collar 44 may have other configurations. For example, the closure base internal collar 44 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, adhesive, or the like.

Figure 8:
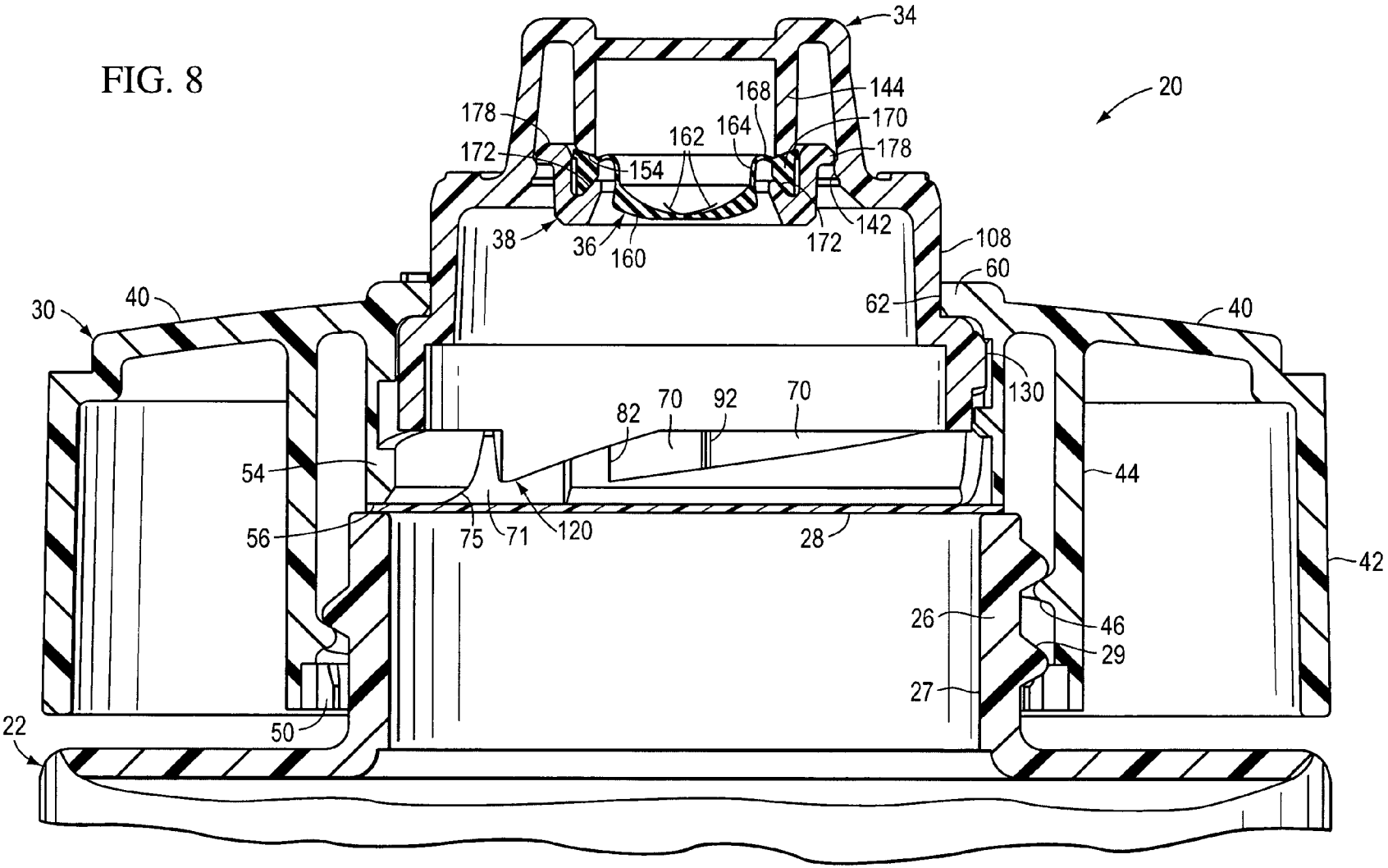
FIG. 8 is a fragmentary, cross-sectional view taken generally along the plan 8-8 in FIG. 7.
Figure 10:
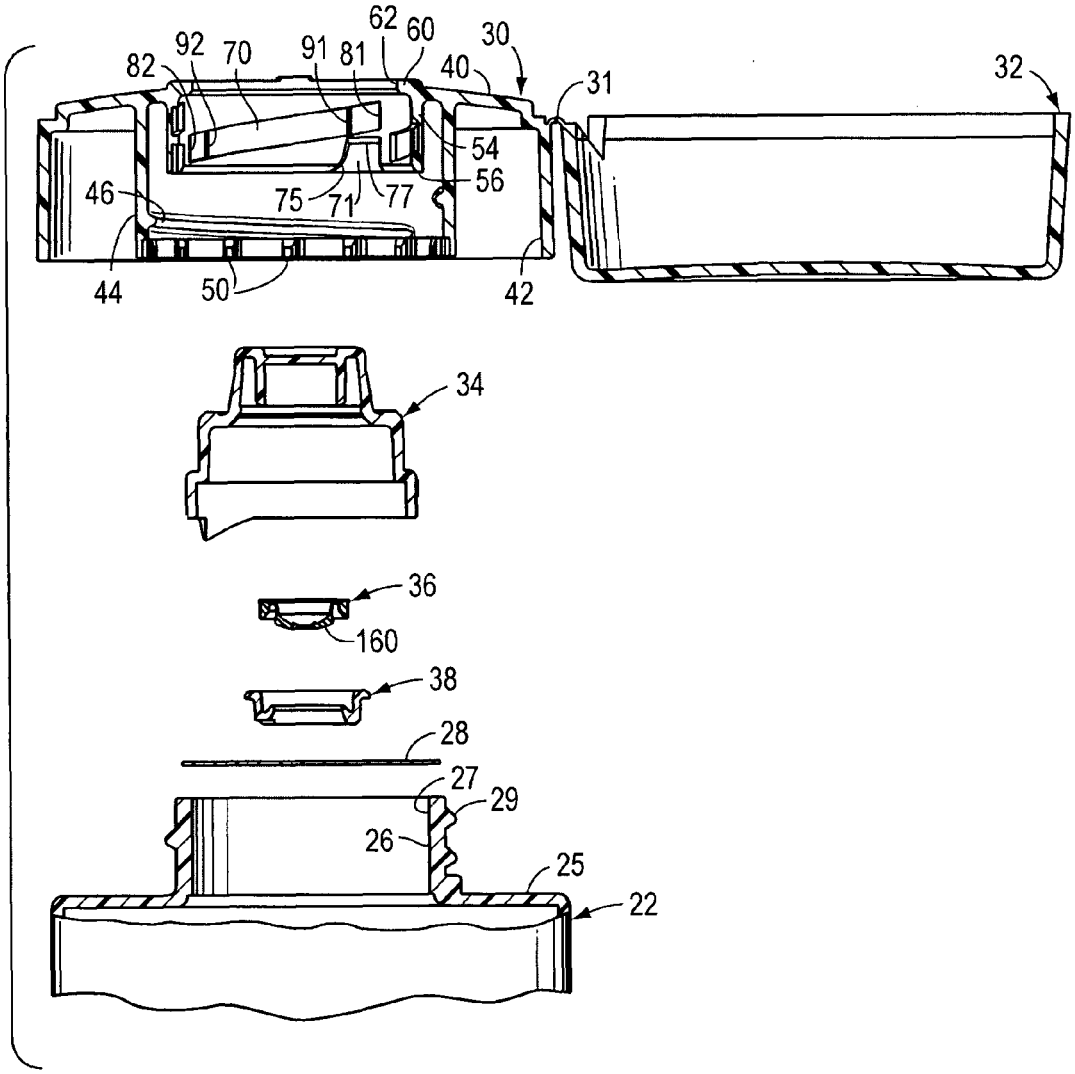
FIG. 10 is an exploded, cross-sectional view of the closure and part of the container shown in FIG. 9.

As can be seen in FIG. 10, the closure base 30 includes an interior sleeve 54 which is concentric with, but is located radially inwardly of, the internal collar 44. The interior sleeve 54 projects axially downwardly from the inner edge of the closure base deck 40. The distal end of the base interior sleeve 54 defines an annular sealing surface 56 (FIG. 15) for sealing against the upwardly facing surface of the liner 28 when the liner 28 is installed on the top of the container neck 26 and when the closure base 30 is installed over the container neck 26 as shown in FIG. 8. When the closure base 30 is threadingly installed on the container neck 26, a sufficient torque is applied to force the annular sealing surface 56 tight against a peripheral portion of the liner 28 over the container neck 26 so as to form a liquid-tight seal which remains effective after the liner 28 is later pierced or otherwise breached when the closure 20 is actuated to open the container 22 as explained in detail hereinafter.

As can be seen in FIGS. 9 and 10, the base interior sleeve 54 defines a receiving passage that extends through the sleeve 54 and, in conjunction with the surrounding collar 44, defines a passage that extends completely through the base 30. The receiving passage through the closure base 30 is adapted to receive the spout 34 as described in detail hereinafter. At the top of the closure base interior sleeve 54, around the inner edge of the annular deck 40, is an annular sealing flange 60. The sealing flange 60 is located axially outwardly of at least part of the length of the receiving passage through the base 30. In the preferred embodiment, the sealing flange 60 is located at the axially outer end or upper end of the length of the receiving passage through the base 30. The sealing flange 60 extends radially inwardly from a peripheral portion of the upper end of the receiving passage defined by the interior sleeve 54, and the sealing flange 60 has an annular seating surface defining a top opening into the receiving passage.

The interior sleeve 54 and the sealing flange 60 are adapted to receive portions of the spout 34. To this end, the interior sleeve 54 defines a generally cylindrical interior surface that includes at least one cam slot or cam track 70 (FIG. 10). In the preferred embodiment, there are three such cam slots or tracks 70. Each slot or track 70 is located axially inwardly of the sealing flange 60. Preferably, each cam track 70 has the form of a channel that opens radially inwardly and that extends part way around the internal circumference of the interior sleeve 54 as a portion or segment of a helical path. The three cam tracks 70 are, in the preferred embodiment, equally spaced around the interior surface of the closure base interior sleeve 54.

As can be seen in FIGS. 10 and 15, associated with each cam track 70 is an axially oriented slot 71 which is located at a predetermined circumferential location at one end of the associated cam track 70 to accommodate installation of the spout 34 as described hereinafter. Each slot 71 has an axially inward open end, and one side has a curved lead-in surface 75 (FIGS. 10 and 15). Each slot 71 has an axially outward end terminating in a radially inwardly extending ramp 77 (FIG. 15) which is adjacent, but which is slightly separated from, the cam track 70. With reference to the cam track 70 illustrated in FIG. 10, each cam track 70 may be regarded, in the preferred embodiment, as extending in a partially helical configuration less than 360° around the closure base interior sleeve 54 between a first end 81 and a second end 82. The associated slot 71 is located adjacent the first end 81 of the cam track 70.

Also, in the preferred embodiment, the closure base interior sleeve 54 defines a first rib 91 projecting into the cam track 70 near the first end 81, and defines a second rib 92 projecting into the cam track 70 near the second end 82. The ribs 91 and 92 provide a tactile sensation and/or audible click indicative of the beginning and ending position of the spout 34 during the operation of the spout 34 by the user as explained in detail hereinafter.

In the preferred embodiment illustrated, where a lid 32 is provided and where the lid 32 is connected to the closure body 30 with a hinge 31 (FIG. 9), the hinge 31 may be of any suitable type. One form of a hinge 31 that may advantageously be used is the snap-action type described in U.S. Pat. No. 6,321,923. Other types of hinges could be used. In some applications, the hinge could be omitted altogether, and the lid 32 need not be connected to the body 30 at all. In other applications, it may be desirable to omit the lid 32 entirely.

Where a lid, such as the lid 32, is employed, it may be desirable to provide a conventional latch bead (not shown) along a portion or portions of the lower edge of the lid 32, and to provide a cooperating conventional latch bead (not shown) or groove (not shown) around a portion or portions of the edge of the closure body deck 40. When the lid 32 is closed, the lid latch bead overrides the body latch bead to provide a latched engagement. To facilitate opening of the lid 32, the lid 32 may include an indentation (not illustrated) to function as a finger lift or thumb lift (not illustrated), and the closure body 30 may also define a finger-receiving recess (not illustrated) or thumb-receiving recess (not illustrated).

The movable spout 34 will next be discussed with reference to FIGS. 9, 13, and 14, among others. With reference to FIG. 9, the spout 34 may be characterized as having an axially innermost portion 101, a smaller diameter intermediate portion 102, and an axially outer portion 103. The axially outer portion 103 is a grippable discharge end having a pair of diametrically opposite tabs 105 (FIG. 9) which can be grasped by the user to twist or rotate the spout 34 (in the direction of rotation indicated by the arrows 100 visible in FIGS. 1, 2, 11, 16, and 17 on the spout 34, as described in detail hereinafter).

The interior of the spout 34 is hollow and may be characterized as defining a dispensing passage extending through the spout. The spout intermediate portion 102 has a peripheral sealing surface 108 (FIGS. 7, 8, and 10) that is adapted to be sealingly engaged by the closure base annular sealing flange sealing surface 62. The sealing engagement between the surfaces 62 and 108 provides a liquid-tight seal in static conditions as well as when the user rotates the spout 34 as discussed hereinafter.

The spout innermost portion 101 at the axially inward end of the spout 34 defines at least one piercing element 120 (FIGS. 13 and 14) to pierce the liner 28 as described in detail hereinafter. In the preferred embodiment illustrated, two piercing elements 120 are provided at diametrically opposite locations on the spout innermost portion 101. In the preferred embodiment, each piercing element 120 includes four surfaces 121, 122, 123, and 124 which generally meet at a location defining a narrow end, edge, or point 126.

Figure 13:
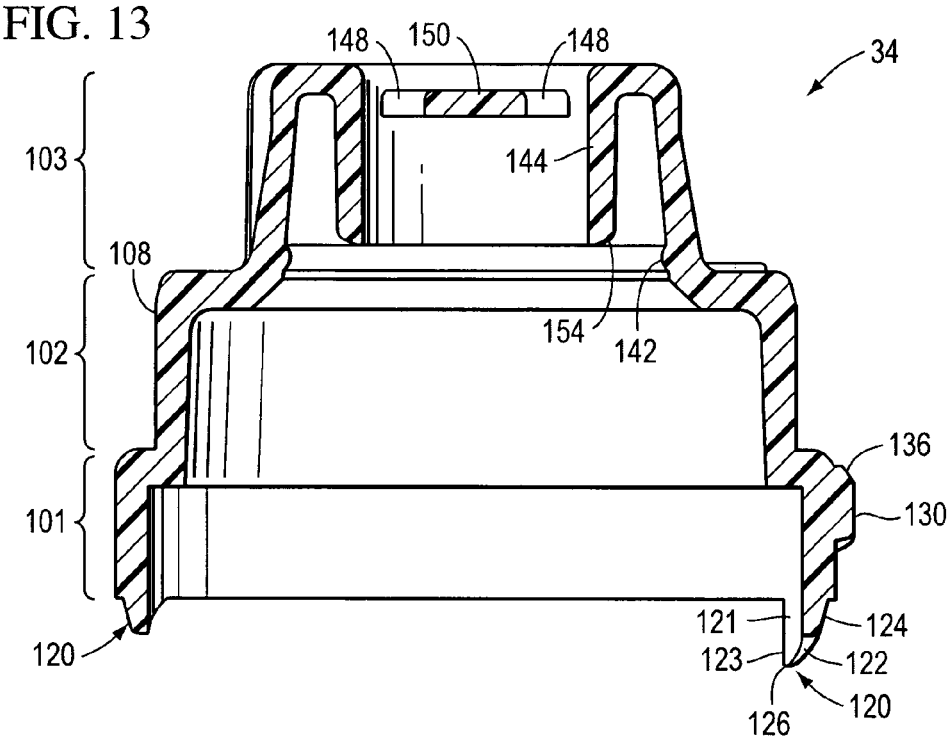
FIG. 13 is a cross-sectional view taken along plane 13-13 in FIG. 11.
Figure 14:
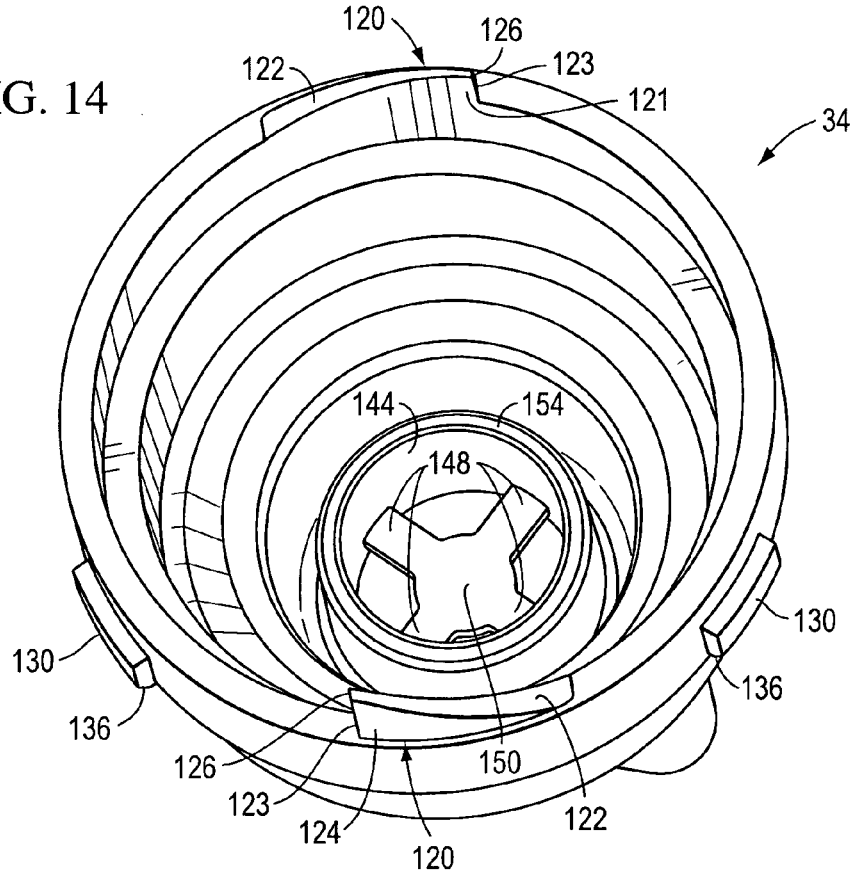
FIG. 14 is an isometric view of the closure spout locking into the bottom, underside of the spout.

As can be seen in FIGS. 13 and 14, at least one cam follower 130 projects radially outwardly from the spout lower portion 101. In the preferred embodiment, there are three cam followers 130 equally spaced about the circumference of the spout lower portion 101. As can be seen in FIG. 13, each cam follower 130 includes an axially outward lead-in surface 136 to accommodate insertion of the spout 34 into the closure base 30 as described hereinafter. Each cam follower 130 has a general configuration of a rectangular prism when viewed in cross section (FIG. 13), but with a "cut off" corner defined by the additional, axially outward lead-in surface 136. Each cam follower 130 is adapted to be received in one of the cam tracks 70. To this end, each cam follower 130, when viewed in side elevation, preferably conforms to the arc of a segment of a helix so as to be matingly received in the channel of one of the helical cam tracks 70.

Figure 11:
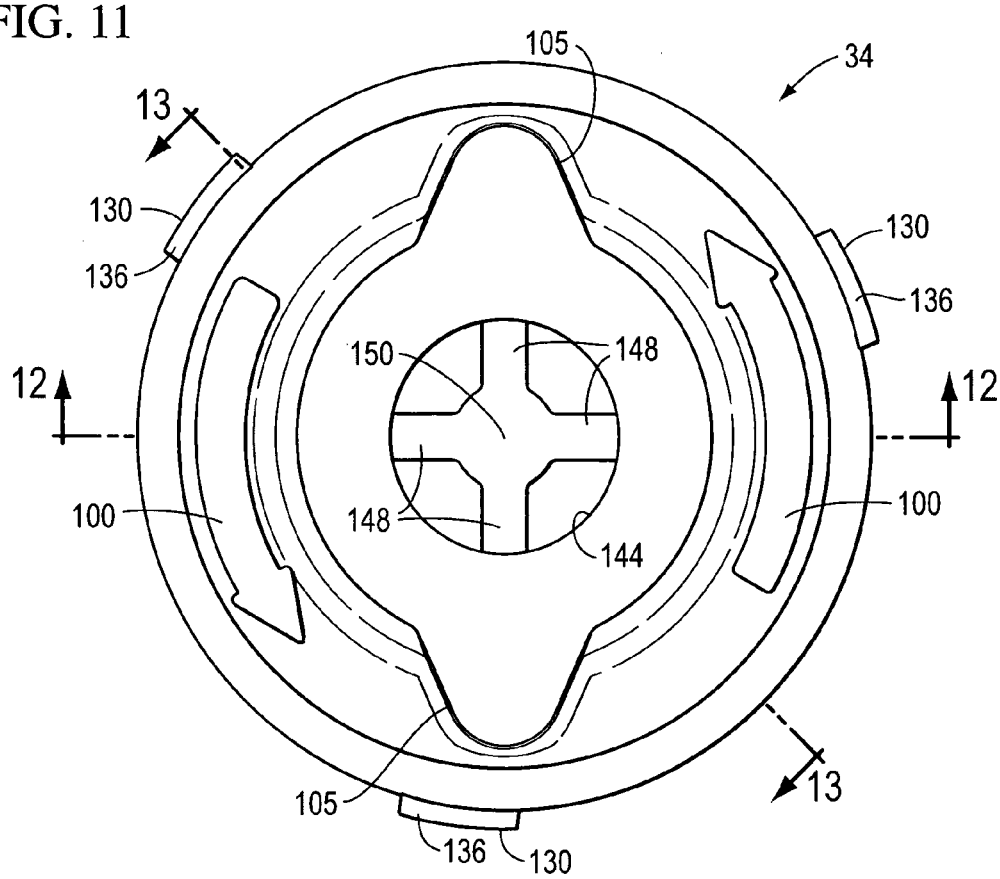
FIG. 11 is a top, plan view of the closure spout shown in FIG. 10.
Figure 12:
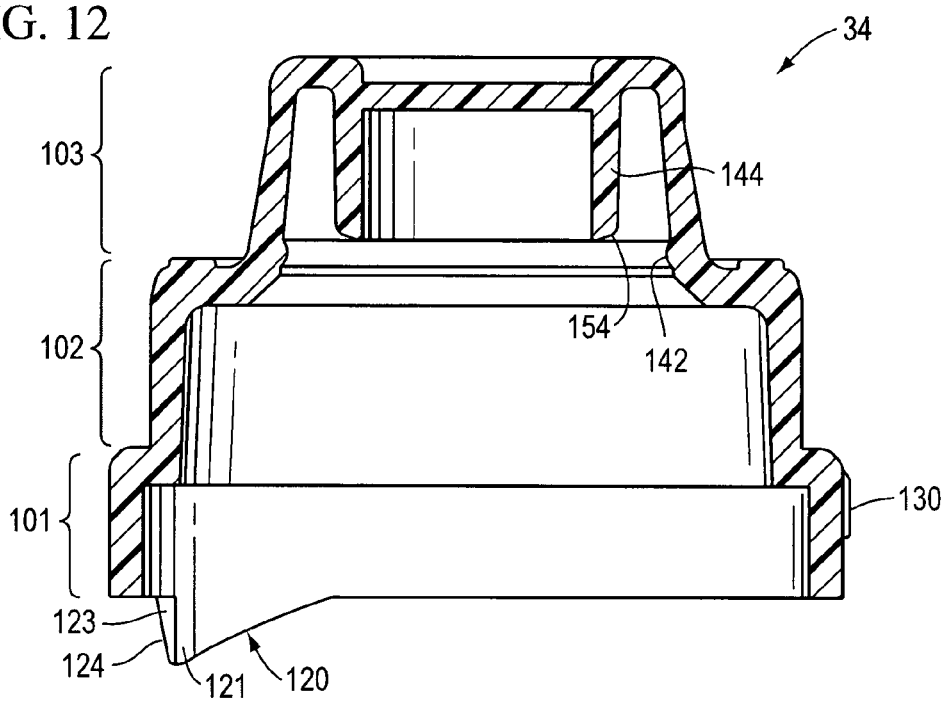
FIG. 12 is a cross-sectional view taken generally along the plane 12-12 in FIG. 11.

In the preferred embodiment, the spout 34 is adapted to receive and hold the valve 36. In alternate embodiments (not illustrated), the particular valve 36, or any other type of valve, need not be employed. In the preferred embodiment employing the valve 36, the spout axially outer end portion 103 includes an annular bead 142 and an axially inwardly extending annular wall 144. Part of the fluent substance dispensing passage is defined by the annular wall 144. The dispensing passage within the upper portion of the annular wall 144 is protected by four arms 148 which extend radially inwardly from the annular wall 144 as can be seen in FIGS. 11 and 14 and which join at a central portion 150.

The axially inward distal end of the annular wall 144 defines a generally frustoconical surface 154 (FIG. 13) which functions as an annular, inwardly angled clamping surface or seat for engaging the peripheral part of the valve 36 as explained in detail hereinafter.

The valve 36 is adapted to be mounted in the closure spout 34 as shown in FIG. 8. The preferred form of the valve 36 is a pressure-actuatable, flexible, slit-type valve which is retained on the inside of the spout 34 by means of the retaining ring 38 as described in detail hereinafter.

The valve 36 is preferably molded as a unitary structure from material which is flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 36 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

In the preferred embodiment illustrated, the valve 36 has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3*d* in the U.S. Pat. No. 5,409,144. The descriptions of those two patents are incorporated herein by reference thereto to the extent pertinent and to the extent not inconsistent herewith.

The valve 36 is flexible and changes configuration between (1) a closed, rest position (as shown closed in an upright package in FIGS. 10 and 11), and (2) an active, open position (not shown). The valve 36 includes a flexible, central portion or head 160 (FIGS. 8 and 10). When the valve 36 is not actuated, the head 160 has a concave configuration (when viewed from the exterior of the closure spout 34). The head 160 preferably has two, mutually perpendicular, planar, intersecting, dispensing slits 162 of equal length which together define a normally closed dispensing orifice. The intersecting slits 162 define four, generally sector-shaped, equally sized flaps or petals in the concave, central head 160. The flaps open outwardly from the intersection point of the slits 162 in response to an increasing pressure differential across the valve 36, when the pressure differential is of sufficient magnitude—in the well-known manner described in the U.S. Pat. No. 5,409,144. The valve 36 could be molded with the slits 162. Alternatively, the valve slits 162 could be subsequently cut into the central head 160 of the valve 36 by suitable conventional techniques.

As can be seen in FIG. 8, the valve 36 includes a skirt or sleeve 164 which extends from the valve central wall or head 160. At the outer end of the sleeve 164, there is a thin, annular flange 168 (FIG. 8) which extends peripherally from the sleeve 164 in a reverse angled orientation when the valve 36 is in the unactuated, rest condition. The thin flange 168 merges with an enlarged, much thicker, peripheral flange 170 which has a generally dovetail-shaped, transverse cross section (as viewed in FIG. 8).

To accommodate the seating of the valve 36 in the spout 34, the top surface of the dovetail valve flange 170 has the same frustoconical configuration and angle as the spout frustoconical surface or seat 154. The other surface (i.e., bottom surface) of the valve flange 170 is clamped by the retaining ring 38 (FIGS. 8 and 9). The retaining ring 38 includes an outwardly or upwardly facing, frustoconical, annular clamping surface 172 (FIGS. 8 and 9) for engaging the axially inner surface (i.e., bottom surface) of the valve flange 170 at an angle which matches the angle of the adjacent, inner surface of the dovetail configuration of the valve flange 170.

The peripheral portion of the retaining ring 38 includes an outwardly projecting flange 178 (FIGS. 8 and 9) for snap-fit engagement with the annular bead 142 (FIGS. 8 and 13) that projects radially inwardly on the inside of the spout 34. Before the spout 34 is installed in the closure base 30, the valve 36 can be inserted into the open bottom end of the spout 34 along with the retaining ring 38. The valve flange 170 is temporarily deformed as the valve 36 is pushed past the spout bead 142 with the ring 38, and the valve flange 170 seats against the spout frustoconical surface or seat 154. The retaining ring 38 can also be pushed past the retaining bead 142 because there is sufficient flexibility in the retaining ring 38 and/or spout 34 to accommodate temporary, elastic deformation of the components as the retaining ring flange 178 passes over, and beyond, the spout bead 142 to create a snap-fit engagement that compresses or clamps the valve flange 170 against the spout frustoconical surface 154 (FIG. 8). This permits the region adjacent the interior surface of the valve sleeve 164 to be substantially open, free, and clear so as to accommodate movement of the valve sleeve 164 as described hereinafter.

In contemplated alternate embodiments (not illustrated), the valve 36 could be suitably attached to a unitary mounting fitment in the spout 34 or otherwise retained in the spout 34 by various means, including swaging, coining, gluing, ultrasonic welding, etc. In another contemplated alternate embodiment (not illustrated), the closure spout 34 could be molded to form a generally rigid, unitary structure, an then the valve 36 could be bi-injection molded into the spout 34 (or, optionally, onto the exterior, distal end of the spout 34) without the need for a retaining ring 38.

When the valve 36 is mounted within the particular form of the spout 34 that is illustrated in FIGS. 8 and 11-14, the central head 160 of the valve 36 lies recessed within the retaining ring 38. In the preferred embodiment, the exterior surface of the valve head 160 at the center of the slits 162 (FIG. 8) is below the clamping surface 154 of the spout 34 when the valve 36 is closed. However, after the membrane 28 is opened as described hereinafter, and when the interior of the package is thereafter pressurized (and typically also inverted) so as to dispense the contents through the valve 36, then the valve head 160 is forced outwardly from its recessed position (shown in FIG. 8) toward the outer end of the package and beyond the retaining ring 38—closer to the open end of the spout 34—and the valve 36 opens.

In order to dispense product, the membrane 28 is first opened as described hereinafter, and the package is then typically tipped downwardly, or is completely inverted (and also squeezed if the container 22 is of the squeezable type). A squeezable container 22 can be squeezed to increase the pressure within the container 22 above the ambient exterior atmospheric pressure. This forces the product in the container 22 toward and against the valve 36, and that forces the valve 36 from the recessed or retracted position (shown in FIG. 8) toward an outwardly extending position (see, for example, the outwardly extending position of the substantially identical valve 46 in FIG. 5 of U.S. Pat. No. 5,676,289 (which also shows the valve 46 in the retracted rest position in dashed lines in FIG. 5 and shows the valve 46 open in the extended position in solid lines in FIGS. 2-4)). The outward displacement of the central head 160 of the valve 36 is accommodated by movement of the relatively thin, flexible sleeve 164. The sleeve 164 moves from an inwardly projecting, rest position to an outwardly displaced, pressurized position, and this occurs by the sleeve 154 "rolling" along itself outwardly toward the outer end of the package.

However, when the internal pressure becomes sufficiently high after the valve head 160 has moved outwardly to the fully extended position, the slits 162 of the valve 36 open to dispense the fluent substance (not shown in the figures). The fluent substance is then expelled or discharged through the open slits 162.

The above-discussed dispensing action of valve 36 in the illustrated preferred form of a squeeze type package with a lid 32 typically would occur only after (1) the lid 32 has been moved to the open position (FIG. 7), (2) the membrane 28 has been opened as described hereinafter, (3) the package has been tipped downwardly or inverted, and (4) the container 22 is squeezed. Pressure on the interior side of the valve 36 will cause the valve 36 to open when the differential between the interior and exterior pressure reaches a predetermined amount. Preferably, the valve 36 is designed to open only after a sufficiently great pressure differential acts across the valve 36—as by applying a sufficiently increased pressure being applied to the inside of the container 22 (e.g., by squeezing the container 22 with sufficient force (if the container 22 is not a rigid container, or as by applying a sufficiently reduced pressure (i.e., vacuum) to the exterior of the spout 34.

Depending on the particular valve design, the open valve 36 may subsequently close when the pressure differential decreases, or the valve 36 may stay open even if the pressure differential decreases to zero. In the preferred embodiment of the valve 36 illustrated for the preferred embodiment of the system shown in FIGS. 1-20, the valve 36 is designed to close when the pressure differential decreases to, or below, a predetermined magnitude. Thus, when the squeezing pressure on the container 22 is released, the valve 36 closes, and the valve head 160 retracts to its recessed, rest position within the spout 34.

Preferably, the valve 36 is designed to withstand the weight of the fluid on the inside of the valve 36 when the container 22 is completely inverted. With such a design, if the container 22 is inverted while the valve 36 is closed, but the container 22 is not being squeezed, then the mere weight of the fluent substance on the valve 36 does not cause the valve 36 to open, or to remain open. Further, if the container 22 on which the closed valve 36 is mounted inadvertently tips over after the lid 32 and membrane 28 have been opened, then the product still does not flow out of the valve 36 because the valve 36 remains closed.

In one preferred embodiment, the petals of the valve 36 open outwardly only when the valve head 130 is subjected to a predetermined pressure differential acting in a gradient direction wherein the pressure on the valve head interior surface exceeds—by a predetermined amount—the local ambient pressure on the valve head exterior surface. The product can then be dispensed through the open valve 36 until the pressure differential drops below a predetermined magnitude, and the petals then close completely.

If the preferred form of the valve 36 has also been designed to be flexible enough to accommodate in-venting of ambient atmosphere as described in detail below, then the closing petals can continue moving inwardly to allow the valve 36 to open inwardly as the pressure differential gradient direction reverses and the pressure on the valve head exterior surface exceeds the pressure on the valve head interior surface by a predetermined magnitude.

For some dispensing applications, it may be desirable for the valve 36 not only to dispense the product, but also to accommodate such in-venting of the ambient atmosphere (e.g., so as to allow a squeezed container (on which the valve is mounted) to return to its original shape). Such an in-venting capability can be provided by selecting an appropriate material for the valve construction, and by selecting appropriate thicknesses, shapes, and dimensions for various portions of the valve head 160 for the particular valve material and overall valve size. The shape, flexibility, and resilience of the valve head, and in particular, of the petals, can be designed or established so that the petals will deflect inwardly when subjected to a sufficient pressure differential that acts across the head 160 and in a gradient direction that is the reverse or opposite from the pressure differential gradient direction during product dispensing. Such a reverse pressure differential can be established when a user releases a squeezed, resilient container 22 on which the valve 36 is mounted. The resiliency of the container wall (or walls) will cause the wall to return toward the normal, larger volume configuration. The volume increase of the container interior will cause a temporary, transient drop in the interior pressure. When the interior pressure drops sufficiently below the exterior ambient pressure, the pressure differential across the valve 36 will be large enough to deflect the valve petals inwardly to permit in-venting of the ambient atmosphere. In some cases, however, the desired rate or amount of in-venting may not occur until the squeezed container is returned to a substantially upright orientation that allows the product to flow under the influence of gravity away from the valve 36 toward the bottom of the container.

It is to be understood that the valve dispensing orifice may be defined by structures other than the illustrated slits 162. If the orifice is defined by slits, then the slits may assume many different shapes, sizes and/or configurations in accordance with those dispensing characteristics desired. For example, the orifice may also include five or more slits.

The dispensing valve 36 is preferably configured for use in conjunction with a particular container and with a specific type of product, so as to achieve the exact dispensing characteristics desired. For example, the viscosity and density of the fluid product can be factors in designing the specific configuration of the valve 36 for liquids, as is the shape, size, and strength of the container. The rigidity and durometer of the valve material, and size and shape of the valve head 160, are also valve characteristics relevant to the desired dispensing characteristics, and can be matched with both the container and the substance to be dispensed therefrom.

Preferably, the valve 36 and the interior of the spout 34 each has a generally circular configuration, and the valve 36 and spout 34 are aligned along a common longitudinal axis. The central intersection of the valve slits 162 lies on the longitudinal axis. The spout 34 may be characterized as having an axially outward discharge flow direction along the axis.

In the preferred embodiment, the structure of the spout arms 148 and disk 150 (FIGS. 13 and 14) is located above the valve 36 to protect the valve 36 when the valve 36 is both closed and open. With reference to FIG. 7, the protective structure of the arms 148 and disk 150 is located far enough outwardly of the valve 36 so as to not interfere with the opening of the valve 36 or adversely affect the dispensing of the fluent substance.

The novel closure system may be provided and used with a different kind of valve (e.g., a mechanically actuated valve) or without any valve, if desired.

The above-described dispensing of a fluid substance through the spout 34 is facilitated by the location of the spout 34 in the closure body or base 30. In particular, with reference to FIG. 7, it can be seen that the spout 34 is at least partly disposed in the receiving passage in the base 30, and that the grippable discharge end of the spout 34 projects axially outwardly from the base 30 beyond the sealing engagement between the spout peripheral sealing surface 108 and the closure base sealing surface 62 on the annular sealing flange 60.

The spout 34, with valve 36 and retainer 38 already mounted therein as described above, can be initially installed in the closure base 30 in an axially outward, non-piercing location (FIGS. 1-7). The initial, non-piercing location of the spout 34 can be conveniently defined in the relation to the subsequent installation of the completed closure 20 on the container 22 over the membrane or liner 28 (which has been previously sealed to the top of the container neck 26)—wherein the spout piercing elements 120 are above the membrane 28. The membrane 28 can be placed on the container 22 at the container filling line after the container 22 has been filled with the fluent substance and then heat sealed to the container before installation of the closure 20. If the membrane 28 is a liner that includes a metal foil layer, the foil layer liner 28 can be heat sealed to the container neck by well-known induction heating or conductive heating methods. Other methods of thermal bonding or adhesive attachment can be used if the liner 28 does not contain a metal foil.

The present invention facilitates installation of the spout 34 (with the valve 36 and retainer ring 38 mounted therein) at the non-piercing location in the closure base 30 so that the piercing elements 120 of the spout 34 will initially be spaced above the top surface of the liner or membrane 28 when the closure 20 is subsequently screwed onto the container 22 over the membrane 28. With reference to the closure bas 30 shown in FIG. 10, it is noted that each axially oriented slot 71 associated with one of the cam tracks 70 is located adjacent the upper end of the cam track 70. To begin installation of the spout 34 (containing the valve 36 and retaining ring 38), the spout 34 is positioned in the bottom open end of the closure base 30, and the spout 34 is then rotated as necessary to position each of the spout cam followers 130 (FIGS. 11-14) in axial alignment with a slot 71.

In an automatic assembly process, the spout 34 (with the valve 36 and the retaining ring 38 mounted therein) can be gripped by a conventional installing chuck for rotating the spout 34 while also moving the spout 34 axially into the closure base 30 under an appropriate axial force (typically generated by an axially loaded spring assembly). With reference to the inverted closure base 30 illustrated in FIG. 15, the spout 34 (with the valve 36 and retaining ring 38 mounted therein) is rotated (either automatically with the installation chuck or manually) in a counterclockwise direction as viewed looking down onto the inverted closure base 30 in FIG. 15. The counterclockwise rotation would cause the spout cam followers 130 (FIG. 14) to initially ride along the annular end surface 56 of the interior sleeve 54 until each cam follower 130 reached the arcuate, lead-in surface 75 of one of the slots 71. Because an axial force is simultaneously applied to the rotating spout 34 (either by an automatic installation chuck or manually), the cam followers 130 slide along the lead-in surfaces 75 and into the slots 71. Further rotation in the counterclockwise direction (as viewed looking down in FIG. 15) is prevented by the vertical wall of each slot 71 opposite the lead-in surface 75. An automatic installation chuck would employ an appropriate torque-limiting rotation drive system that would prevent the application of excessive torque to the spout 34 so as to avoid deforming or otherwise damaging the components as the spout 34 is pushed axially into the closure base 30 guided by the cam followers 130 in the slots 71.

When the cam followers 130 reach the radially, inwardly extending lead-in ramp 77 (FIG. 15) at the end of each slot 71, each cam follower 130 rides along the ramp 77 and into the upper end of the associated track 70. There is sufficient flexibility in portions of the spout 34 and/or in portions of the closure base 30 so as to accommodate temporary, elastic deformation of the spout 34 and/or closure base 30 by an amount sufficient to permit the cam followers 130 to slide up the ramps 77 and enter into the cam tracks 70. This arrangement assures that the spout 34 (with the valve 36 and retaining ring 38 mounted therein) is initially located at its elevated, non-piercing position within the closure base 30 so that the spout piercing elements 120 are initially located above the liner or membrane 28 as shown in FIG. 8 when the closure 20 is subsequently screwed onto the container 22.

Figure 2:
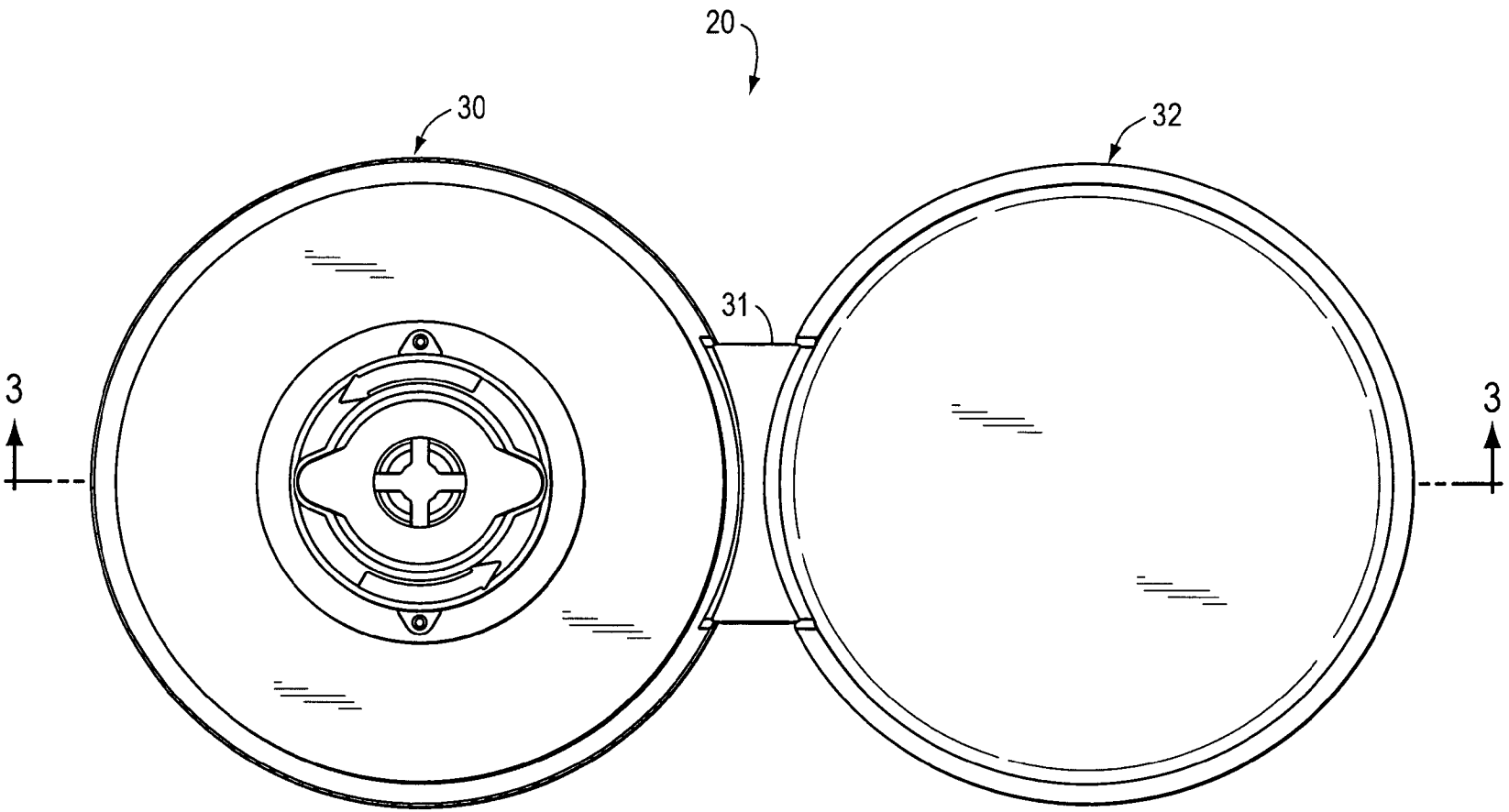
FIG. 2 is a top plan view of the closure shown in FIG. 1.

Further, in the preferred form of the invention illustrated in FIG. 10, the ribs 91 adjacent the upper end each cam track 70 may be designed to provide some resistance to rotation of the spout 34 (in the counterclockwise direction as viewed looking down on the exterior top of the closure base 30 and spout 34 in FIG. 2). If the user were to rotate the spout 34 in the counterclockwise direction as viewed looking down on the top of the spout 34 and closure base 30 in FIG. 2, then the initial resistance offered by the upper rib 91 (FIG. 10) would have to be overcome, and as the spout cam follower 130 passes over the rib 91, a tactile sensation and/or audible click would be indicative of the rotation of the spout 34 away from the fully elevated, non-piercing location. Similarly, if the user were to continue rotating the spout 34 in the counterclockwise direction as viewed looking down on the top of the spout 34 and closure base 30 in FIG. 2, then the spout cam followers 130 would ultimately engage the ribs 92 (FIG. 10) at the lower ends of the cam tracks 70. As the cam followers 130 pass over the lower ribs 92, and then pass beyond the lower ribs 92 in the counterclockwise direction of rotation, the user would hear an audible click, and the user would be able to continue further rotation only until the cam followers 130 abut the lower ends of the cam tracks 70 at the fully lowered location of the spout 34 (which is the most axially inward position of the spout 34 relative to the closure base 30 and at which location the spout cutting elements 120 would project significantly below the elevation of the membrane 28 if the closure 20 was mounted on a container over such a membrane 28).

After the closure 20 is properly assembled with the spout 34 initially located in the fully elevated, non-piercing location, the closure 20 can be screwed onto the top of a container (e.g., container 22) that has been filled with a fluid substance and sealed with a liner (e.g., membrane 28).

Figure 17:
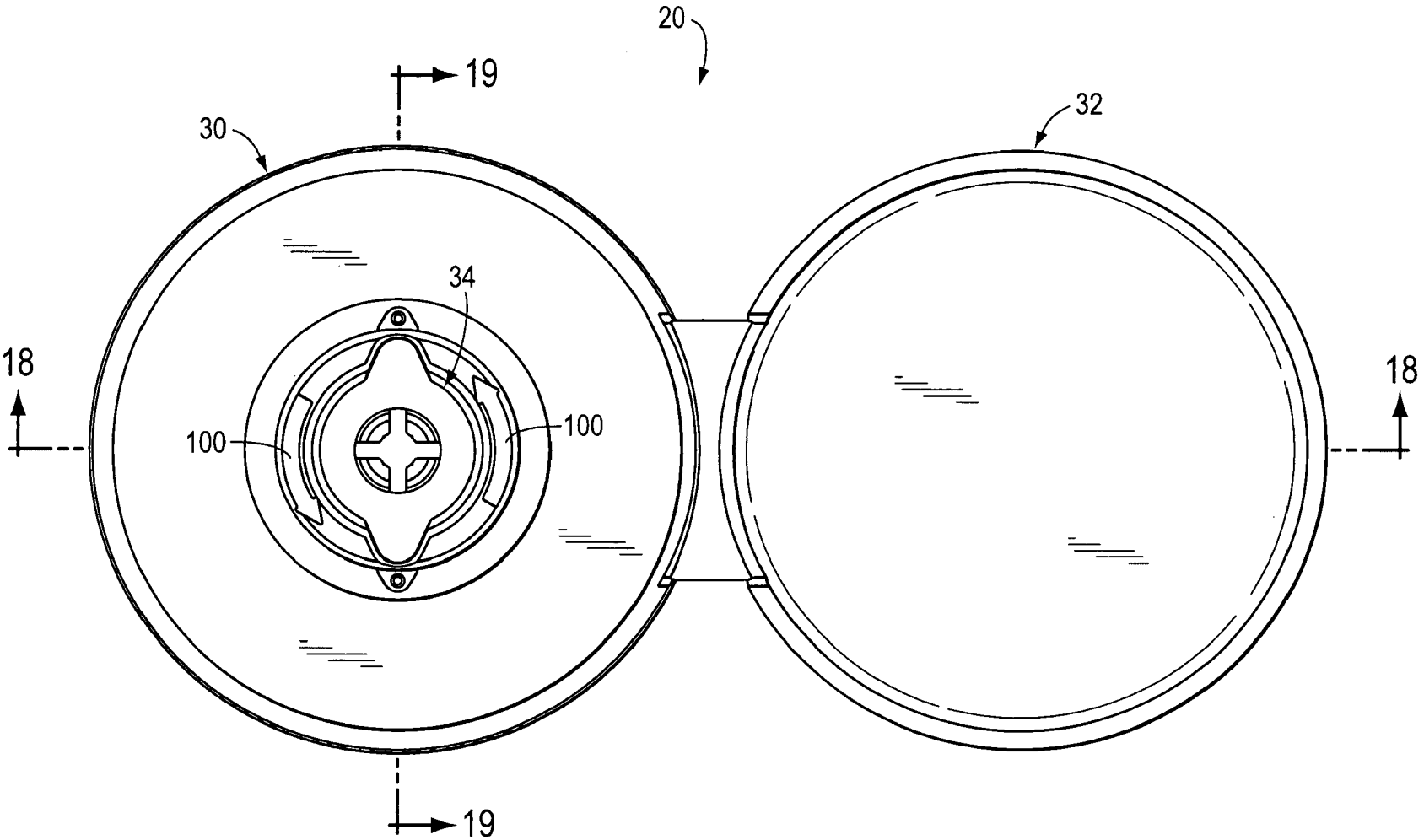
FIG. 17 is a top, plan view of the closure shown in FIG. 16.
Figure 18:
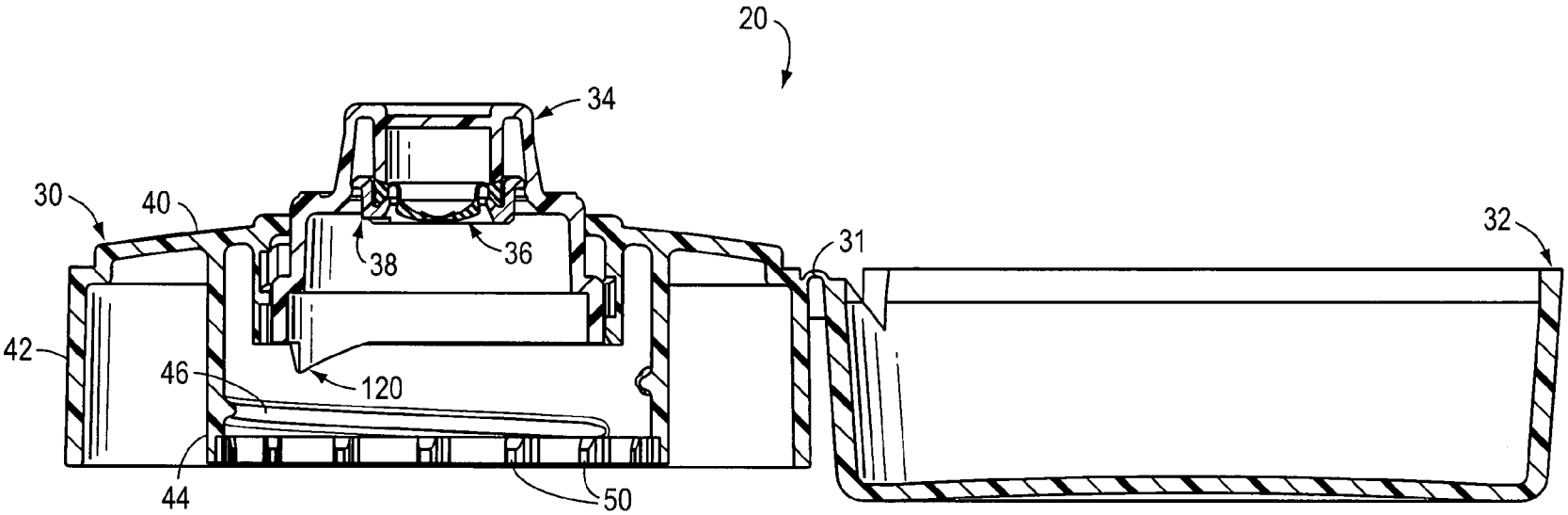
FIG. 18 is a cross-sectional view taken along plane 18-18 in FIG. 17.
Figure 19:
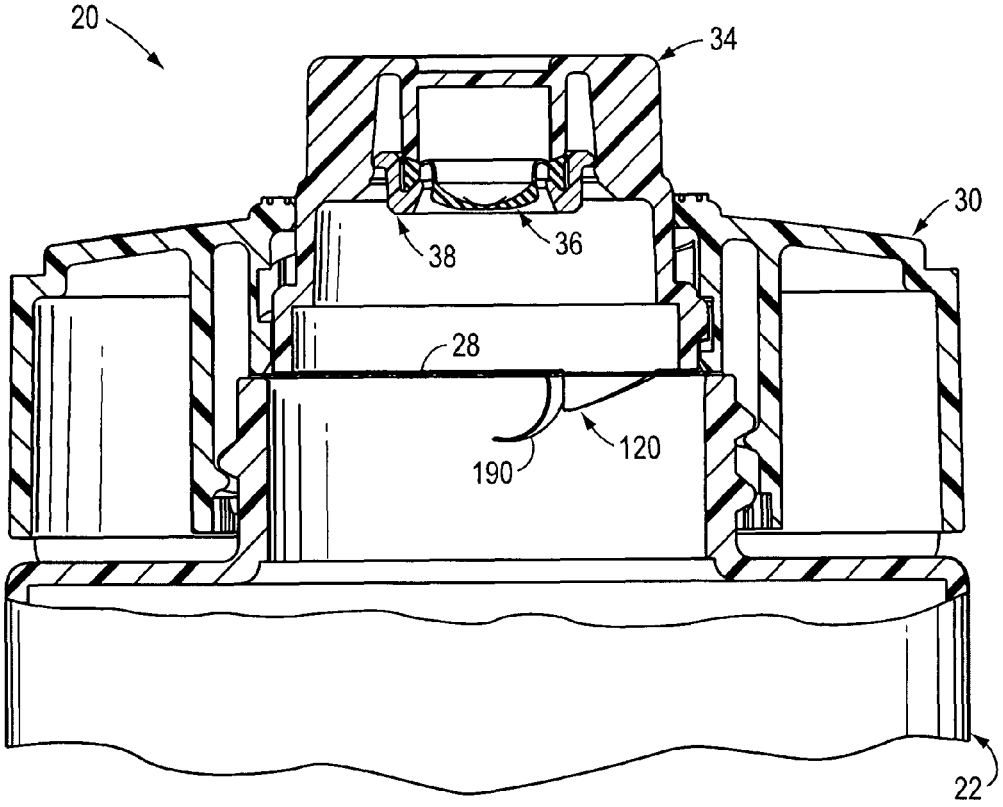
FIG. 19 is a cross-sectional view taken along the plane 19-19 in FIG. 17, but FIG. 19 also shows the closure installed on the container and shows piercing of the membrane liner at the top of the container.

The operation of the closure 20 to open the container sealed with the membrane 28 is next described with reference to some of the figures. FIGS. 1 and 8 show the spout 34 at the initial installation orientation of the spout 34 in the closure 20 wherein the spout 34 is at the maximum elevation location (i.e., most axially outward location) relative to the closure base 30 and wherein the piercing elements 120 are at their furthest location away from (e.g., above) the membrane 28. FIGS. 17 and 18, on the other hand, show the spout 34 in the most axially inward location relative to the closure base 30.

When the spout 34 is rotated for the first time by the user in the counterclockwise direction from the position illustrated in FIG. 1 (the highest, non-piercing position) to the lowered position shown in FIGS. 16-20, the spout 34 and the piercing elements 120 thereon (FIGS. 19 and 20) move downwardly (axially inwardly) so that the membrane 28 is initially pierced by the point 126 of each piercing element 120. As the spout 34 continues to be rotated by the user to open the membrane 28 (by rotating the spout 34 in the counterclockwise direction as viewed looking down on the top of the spout 34), the piercing elements 120 move in a clockwise direction as viewed in FIG. 20 from inside the container 22 looking up at the membrane 28. The points 126 of the piercing elements 120 move further axially inwardly into, and through, the membrane 28 as each piercing element 120 moves in a circular arc (FIG. 20). As the piercing elements 120 move further into, and through, the membrane 128, the width of the puncture, tear, cut or opening produced by each piercing element 120 becomes wider because each piercing element 120 increases in thickness with increasing distance upwardly (i.e., axially outwardly) from the point 126 (see, for example, the end view of the cutting element 120 visible in FIG. 12). The puncturing and cutting of the membrane 28 by each element 120 creates a flap 190 in the membrane 28. Each flap 190 is narrowest at its free, distal end, and becomes wider away from the free, distal end. The flap width increases to the maximum width resulting from the engagement with the maximum width of the piercing element 120 at the top of the piercing element 120 where the piercing element 120 merges with the rest of the spout 34. In the preferred embodiment illustrated, as each piercing element 120 moves in an arcuate path through the membrane 28, each piercing element 120 essentially "plows" the flap 190 out of a 45 degree long circular arc cut or opening in the membrane 28.

The flaps 190 remain connected to the rest of the membrane 28, and thus no separate waste pieces are created. The opening, or tear, or cut formed by each piercing element 120 in the membrane 28 is preferably long enough to extend somewhat past the length of the piercing element 120 so as to provide a sufficient flow passage for the fluent substance to be dispensed—even if the piercing elements 120 remain in the lowered position extending into, and through, a portion of the membrane 28. Thus, the user need not twist the spout 34 in the reverse direction of rotation in order to move the spout 34 back to the fully elevated, non-piercing location. The piercing spout 34 may be left in the fully lowered location, and sufficient flow can pass through the cut, torn, or open regions of the membrane 28 adjacent the trailing ends of the piercing elements 120.

The length of each cam track 70 may be designed to facilitate the creation of sufficiently long opening in the membrane 28 to accommodate the dispensing of the fluent substance through the openings in the membrane 28. A highly viscous substance may require a longer cam track arrangement to provide longer circular arc cuts or openings in the membrane 28 to provide a greater flow area. A less viscous substance may not require such a long cam track arrangement. Alternatively, or in addition, the thickness of the upper portions of the cutting elements 120 could be increased so as to provide wider cuts or openings in the membrane 28.

In one presently contemplated, alternate design (not illustrated), only one cam track 70, rather than three cam tracks 70, need be provided. More than three cam tracks could also be provided. It will also be appreciated that only one cam follower, or more than three cam followers, could be employed in alternate embodiments (not illustrated). However, in the presently preferred embodiment illustrated in FIGS. 1-20, three cam tracks 70 are employed in the closure base 30 to receive three cam followers 130 on the spout 34, and this arrangement has been found to provide a good balance and operation. One should also appreciate that the locations of the cam tracks 70 and cam followers 130 could be reversed. That is, in an alternate embodiment (not illustrated), a cam track or tracks could be provided on the radially outer surface of the spout 34, and the cam follower or followers (e.g., pins or other protrusions) could extend radially inwardly from the closure base interior sleeve 54 into the tracks on the spout.

In one presently contemplated alternate embodiment (not illustrated), only one piercing element 120 could be provided. In other designs, three or more piercing elements 120 could be provided instead of the two elements employed in the illustrated preferred embodiment.

With reference to FIG. 8, it will be appreciated that the spout 34 is prevented from being removed from the closure base 30 by the overlying engagement of the closure base flange 60 with the enlarged bottom portion 101 of the spout 34. Further, in the preferred embodiment, wherein the closure base 30 is also provided with at least one pawl tooth 50 (FIG. 15) to engage anti-rotation ratchet teeth 29A on the container (FIGS. 6 and 9), the closure 20 cannot readily be removed by the user. Thus, the package remains secure and relatively tamper-resistant. If someone had twisted the spout 34 to puncture the membrane 28 and then rotated the spout 34 back to the elevated position, a subsequent user would be able to tell if the membrane 28 had been punctured by initially tipping over the container and/or squeezing the container to see if the fluent substance could be dispensed. If the fluent substance could be dispensed, that would provide an indication that the membrane 28 had been previously breached.

In the preferred embodiment illustrated in FIGS. 1-20, wherein a pressure-actuated valve 36 is installed in the spout 34, it may not be necessary in some applications to also provide a lid 32. However, in order to keep dirt or other foreign materials out of the dispensing spout 34, the use of a lid 32 would generally be desirable.

The spout 34 in the closure system of the present invention can be easily and effectively operated to pierce (e.g., puncture, rupture, break, tear, cut, etc.) the membrane 28 that is initially in place to maintain the integrity of the fluent substance that is to be discharged. The closure system does not require the complete removal of a separate element (such as the membrane 28) prior to discharging the contents—thereby eliminating the possibility of losing an important component of the dispensing system.

Embodiments of the present invention wherein the spout 34 (and valve 36 retaining ring 38, if employed) and the closure base 30 are separately manufactured components (such as the embodiment illustrated in FIGS. 1-20) can be relatively easily assembled by the manufacturer.

The system of the present invention accommodates use with packages wherein the membrane 28 is sealed to, and across, the top of the container 22 as well as with other, optional designs wherein the membrane 28 can be secured to the underside of the closure base 30 instead of, or in addition to, the top of the container 22.

When the present invention employs the optional valve 36 (as in the preferred embodiment illustrated in FIGS. 1-20), the valve 36 provides additional advantages, such as preventing spillage of the fluent substance if the opened package is inadvertently tipped over. Also, the valve 36 can provide additional control of the dispensing process (including minimizing, if not eliminating, the dripping of fluent material from the spout 34 after the dispensing process has been terminated by the user). The valve 36 also can function to eliminate or minimize contaminant ingress—even if no external lid 32 is provided for closing over the top of the spout 34.

The dispensing closure system of the present invention accommodates the use of the a membrane 28, such as a conventional liner, without requiring removal of the liner from the container or system. The dispensing closure system of the present invention permits the user to conveniently open a membrane (such as a conventional liner 28) without having to manipulate the package so as to first expose the membrane and without requiring removal of the membrane per se. The membrane or liner, after piercing, remains on the system so that it does not present a litter problem or choking problem for children.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure for a container that has an opening to the container interior where a fluent substance may be stored, and wherein a membrane is interposed between the container and dispensing closure, said dispensing closure comprising:

(A) a base for extending from said container at said container opening, said base defining (1) a receiving passage through said base, and (2) an annular sealing flange that (a) is located axially outwardly of at least part of the length of said receiving passage, and (b) extends radially inwardly from a peripheral portion of said receiving passage to define an opening into said receiving passage;

(B) a movable spout that (1) is at least partly disposed in said base receiving passage, (2) has a dispensing passage extending through said spout, (3) has a grippable discharge end that (a) is located at an axially outward end of said spout, and (b) projects axially outwardly from said base, (4) has a peripheral sealing surface that is sealingly engaged by said base annular sealing flange, and (5) has a piercing element at an axially inward end of said spout;

(C) a cam track located in one of said base and spout axially inwardly of said annular sealing flange; and (D) a cam follower that is (1) located on he other one of said base and spout, and (2) engaged in said cam track whereby said spout grippable discharge end can be grasped to rotate said spout for moving said spout axially from an axially outward, non-piercing location to an axially inward, piercing location wherein said cam follower projects radially outwardly on said spout;

said cam follower has an axially outward lead-in surface that extends increasingly inwardly in the radial direction with increasing distance in the axially outward direction;

said closure base has an interior sleeve that (1) is located axially inwardly of said base annular sealing flange (2) extends axially inwardly, and (3) has a cylindrical interior surface that defines, at least in part, said base receiving passage;

said cam track is defined in said interior surface of said closure base interior sleeve;

said interior sleeve has an axially oriented slot located (1) axially inwardly of said cam track, and (2) at a predetermined circumferential location;

said slot has an axially inward open end for receiving said cam follower during installation of said spout in said base;

said slot has an axially outward end terminating in a radially inwardly extending ramp adjacent, but separated from, said cam track; and at least one of said base and spout is sufficiently resilient to accommodate insertion of said spout into said base with said cam follower in said slot to force said cam follower against and past said ramp into said cam track.

2. The closure in accordance with claim 1 in which said closure further includes a lid hingedly attached to said base for moving between (1) a closed position on top of said base over said spout, and (2) an open position in which said grippable discharge end of said spout is exposed.

3. The closure in accordance with claim 1 in which (A) said closure base includes a body that is initially separate from, but subsequently attachable to, said container around said container opening; and (B) said closure is adapted for use with said membrane in the form of a liner sealed to the container over the container opening.

4. The closure in accordance with claim 1 in which (A) said closure base includes a body that is initially separate from, but subsequently attachable to, the container around said container opening; and (B) said closure base is adapted for use with said membrane in the form of a liner that can be initially sealed to said closure base before said closure base is attached to said container.

5. The closure in accordance with claim 1 in which said spout grippable discharge end has an exterior configuration defining two oppositely directed tabs.

6. The closure in accordance with claim 1 in which said base closure is adapted for use on a container having (1) a neck defining said container opening, and (2) a thread on said neck; and said closure base has a thread for engaging said container neck thread to permit said base to be screwed onto said container neck.

7. The closure in accordance with claim 6 in which said closure is adapted for use with a container having anti-rotation ratchet teeth located on the circumference of said container neck axially inwardly of said container neck thread, and said closure base has at least one pawl tooth shaped to (1) deflect past said container anti-rotation ratchet teeth when said base is screwed onto said container, and (2) abut at least one of said container anti-rotation ratchet teeth when torque is applied to said base in the unscrewing direction of rotation thereby preventing unscrewing of said base from said container.

8. The closure in accordance with claim 1 in which said closure base includes an internal female thread for engaging a mating male thread on a container.

9. The closure in accordance with claim 1 in which said cam track extends in a partially helical configuration less than 360° around said closure base interior sleeve between a cam track first end and a cam track second end;

said closure base interior sleeve defines (1) a first rib projecting into said cam track near said first end, and (2) a second rib projecting into said cam track near said second end;

at least one of said closure base and spout is sufficiently resilient to accommodate movement of said cam follower past each said rib when said spout is rotated with sufficient torque; and movement of said cam follower from an end of said cam track past each of said ribs provides at least a tactile sensation indicative of the beginning and ending position of the cam follower as the cam follower is moved from one end of said cam track to the other end of said cam track.

10. The closure in accordance with claim 1 for use with a container that has an annular top end defining (1) an opening occluded by said membrane in the form of a liner sealed to said annular top end, and (2) an external, male thread around said opening, and in which said closure is a dispensing closure that is separate from, but subsequently attachable to, said container around said container opening;

said closure base has a hollow, generally cylindrical internal collar which has an internal, female thread for threadingly engaging said external male thread on said container;

said base includes an annular deck at the top of said base around said receiving passage; and said spout grippable discharge end extends outwardly beyond said deck.

11. The closure system in accordance with claim 1 in which said piercing element includes four surfaces which converge toward a blunt point.

12. The closure in accordance with claim 1 in which said closure spout further includes a dispensing valve that (1) is mounted in said spout in said spout discharge passage to locate said valve adjacent the said grippable discharge end of said spout, (2) comprises a flexible, resilient material, and (3) defines at least one normally closed dispensing orifice which opens to permit flow therethrough in response to a pressure differential across said valve.

13. The closure in accordance with claim 12 in which said valve has a valve head; and said dispensing orifice is defined in said valve head by a plurality of slits that extend (1) through said valve head from an exterior side to an interior side, and (2) laterally from a common origin so that petals are defined by said slits whereby said orifice is capable of opening by outward deflection of said petals when the pressure in the interior of said valve exceeds the pressure on the exterior of said valve by a predetermined amount.

14. The closure in accordance with claim 12 in which said valve dispensing orifice is closed when the pressure on the interior of said valve is substantially the same as the pressure on the exterior of the valve.

15. The closure in accordance with claim 12 in which said valve is a self-closing valve;

said valve opens outwardly when the pressure against the side of said valve facing the interior of the container exceeds the pressure acting against the side of said valve exposed to ambient atmosphere by a predetermined amount; and said valve returns from an open condition to a closed condition after the pressure acting on the side of the valve facing the interior of the container decreases sufficiently.

16. The closure in accordance with claim 12 in which said valve has an annular flange;

said spout defines a generally annular seat facing generally away from said spout grippable discharge end; and said closure further includes a retaining ring having a portion engaged with said spout to retain said valve in said spout wherein said valve annular flange is clamped by said retaining ring against said annular seat in said spout.

17. The closure in accordance with claim 16 in which said retaining ring is in a snap-fit engagement with said spout;

said valve annular flange has a dovetail cross section defining a frustoconical outer surface and a frustoconical inner surface;

said spout seat is a frustoconical surface engaging said frustoconical outer surface of said valve annular flange; and said retaining ring has a frustoconical clamping surface engaging said frustoconical inner surface of said valve annular flange to clamp said valve annular flange between said retaining ring and said spout seat.

* * * * *